US010670224B1

(12) United States Patent
Lin et al.

(10) Patent No.: US 10,670,224 B1
(45) Date of Patent: Jun. 2, 2020

(54) TUNABLE HOLOGRAPHIC LASER LIGHTING FOR VERSATILE LUMINAIRE

(71) Applicant: ABL IP HOLDING LLC, Conyers, GA (US)

(72) Inventors: Guan-Bo Lin, Reston, VA (US); David P. Ramer, Reston, VA (US); An Mao, Jersey City, NJ (US); Januk Aggarwal, Alexandria, VA (US); Rashmi Kumar Rogers, Herndon, VA (US)

(73) Assignee: ABL IP HOLDING LLC, Conyers, GA (US)

( * ) Notice: Subject to any disclaimer, the term of this patent is extended or adjusted under 35 U.S.C. 154(b) by 0 days.

(21) Appl. No.: 16/227,128

(22) Filed: Dec. 20, 2018

(51) Int. Cl.

| | |
|---|---|
| ***F21V 5/00*** | (2018.01) |
| ***F21V 9/38*** | (2018.01) |
| ***F21V 14/04*** | (2006.01) |
| ***F21V 14/06*** | (2006.01) |
| ***F21V 14/00*** | (2018.01) |
| ***F21V 7/00*** | (2006.01) |
| *F21Y 115/30* | (2016.01) |

(52) U.S. Cl.
CPC ..... *F21V 5/003* (2013.01); *F21V 7/0008* (2013.01); *F21V 9/38* (2018.02); *F21V 14/003* (2013.01); *F21V 14/04* (2013.01); *F21V 14/06* (2013.01); *F21Y 2115/30* (2016.08)

(58) Field of Classification Search
CPC ..... F21V 5/003; F21V 9/38; F21V 7/0008; F21V 14/003; F21V 14/04; F21V 14/06
See application file for complete search history.

(56) References Cited

U.S. PATENT DOCUMENTS

| | | | | |
|---|---|---|---|---|
| 6,483,613 | B1 | 11/2002 | Woodgate et al. | |
| 6,870,671 | B2 | 3/2005 | Travis | |
| 2009/0067156 | A1 | 3/2009 | Bonnett et al. | |
| 2011/0279039 | A1 | 11/2011 | Kishimoto | |
| 2012/0050645 | A1 | 3/2012 | Okada et al. | |
| 2013/0250381 | A1* | 9/2013 | Toko | G02B 5/32 359/19 |

(Continued)

OTHER PUBLICATIONS

Wikipedia, "Holography," https://en.wikipedia.org/wiki/Holography, last edited on Oct. 8, 2018, 27 pages.

(Continued)

*Primary Examiner* — Anne M Hines
(74) *Attorney, Agent, or Firm* — RatnerPrestia

(57) ABSTRACT

A tunable luminaire includes a laser light source and at least two different holograms. A beam of light is selectively directed from the laser light source to a first hologram in a first state of the luminaire to enable the luminaire to output light of a first characteristic. A beam of light is selectively directed from the laser light source to a second hologram in a second state of the luminaire to enable the luminaire to output light of a different second characteristic. For example, in the different states, different patterns of light from the holograms pass through and pump different photoluminescent materials, to produce luminaire light outputs in the different states having a different color characteristic. In other examples, in the different states, different patterns of light from the holograms pass through different elements or portions of an optical system to provide light outputs having different distributions.

26 Claims, 17 Drawing Sheets

(56) References Cited

U.S. PATENT DOCUMENTS

| | | | |
|---|---|---|---|
| 2014/0036361 | A1 | 2/2014 | Woodgate et al. |
| 2015/0088385 | A1 | 3/2015 | Fleury |
| 2018/0038558 | A1 | 2/2018 | Woisetschlaeger et al. |
| 2018/0038559 | A1 | 2/2018 | Mueller |

OTHER PUBLICATIONS

Entire prosecution history of U.S. Appl. No. 16/030,193, filed Jul. 9, 2018, entitled "Laser Illumination Lighting Device With Solid Medium Freeform Prism or Waveguide."
Entire prosecution history of U.S. Appl. No. 16/227,028, filed Dec. 20, 2018, entitled "Luminaire Using Holographic Optical Element and Luminescent Material."
Notice of Allowance for U.S. Appl. No. 16/030,193, dated Jul. 17, 2019, 14 pages.
Non-final Office Action for U.S. Appl. No. 16/227,028 dated Nov. 7, 2019, 21 pages.
Notice of Allowance for U.S. Appl. No. 16/227,028, dated Mar. 16, 2020, 11 pages.

* cited by examiner

FIG. 23
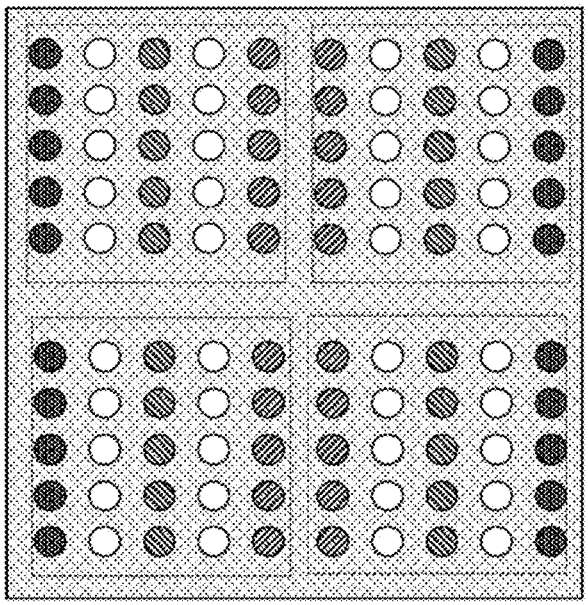
FIG. 24
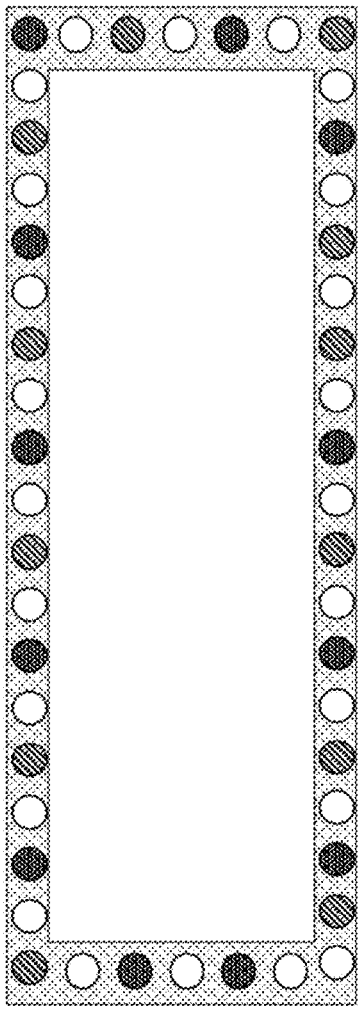
FIG. 25
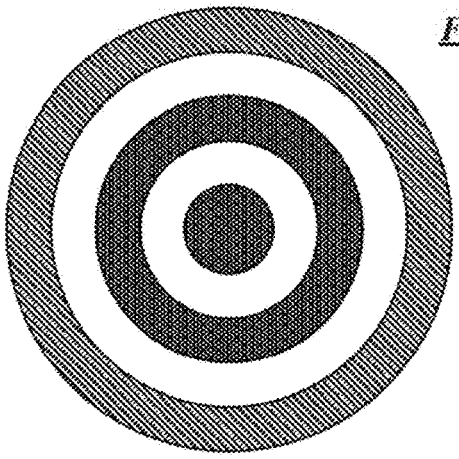
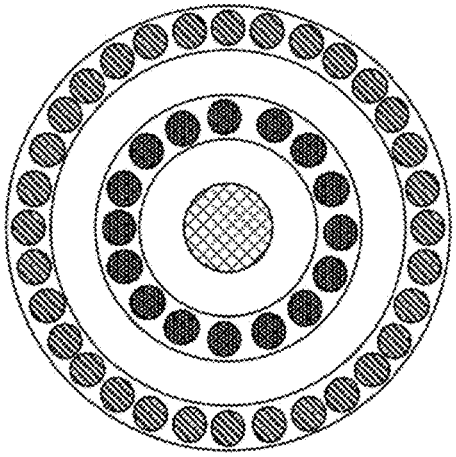
FIG. 26

TUNABLE HOLOGRAPHIC LASER LIGHTING FOR VERSATILE LUMINAIRE

CROSS-REFERENCE TO RELATED APPLICATION

This application is related to U.S. application Ser. No. 16/030,193, Filed Jul. 9, 2018, entitled LASER ILLUMINATION LIGHTING DEVICE WITH SOLID MEDIUM FREEFORM PRISM OR WAVEGUIDE, the entire contents of which are incorporated herein by reference.

This application also is related to U.S. application Ser. No. 16/227,028, Filed concurrently herewith on Dec. 20, 2018, entitled LUMINAIRE USING HOLOGRAPHIC OPTICAL ELEMENT AND LUMINESCENT MATERIAL, the entire contents of which are incorporated herein by reference.

TECHNICAL FIELD

The present subject matter relates to various examples of an artificial lighting luminaire for a general illumination application, which utilizes a laser light source, a holographic optical element, and a photoluminescent material, wherein an operational aspect of the laser light source or the holographic optical element is controllable to provide a dynamically variable feature in the luminaire output.

BACKGROUND

Electrically powered artificial lighting for general illumination purposes has become ubiquitous in modern society. Electrical lighting equipment is commonly deployed, for example, in homes, buildings of commercial and other enterprise establishments, as well as in various outdoor settings. The light sources utilized in luminaires for general illumination have evolved from traditional sources, such as incandescent or fluorescent lamps, to increasingly efficient solid state light sources. The most common form of solid state light sources utilized in luminaires is the light emitting diode or "LED."

LED based general illumination lighting, however, has limitations. LEDs, for example, typically emit light over a rather broad angular output field, typically called Lambertian angular distribution with 120-degree beam angle (full-width at half-maximum). Even with optical elements to somewhat narrow the output angle range, some light often is lost outside the desired area of illumination. To achieve desired overall lumen output, luminaires for most general lighting applications have some number of LEDs. Due to the wide angular distribution, the LEDs usually are deployed in an array or other grid pattern of point sources.

Laser light sources are good pumping sources and have high power in a relatively small package with extremely strong directionality. A phosphor or other photo luminescent material pumped by ultraviolet (UV) or blue light from a laser emitter produces longer wavelength light. With an appropriate phosphor, for example, such laser light may be converted into a white light output. Due to safety concerns and low optical efficiency, however, laser light sources are typically not utilized as a light source for general illumination in the lighting industry. If not fully converted or otherwise filtered out, UV may be harmful to the skin or eyes of people exposed to illumination from a luminaire that uses UV pumped phosphor. Blue laser light is not dangerous because of the wavelength of blue colored light, but instead may be harmful because the laser light beam is highly focused and coherent, resulting in a high power density light source.

Although blue laser light sources have been utilized in automobile headlamp applications, the designs for those lighting devices involve several mirrors to deflect the blue laser light and have many air gaps. The air gaps and mirrors in the design of such lighting devices may be problematic for several reasons. In the event of breakage of the lighting device (e.g., during an automobile accident), laser light containment may be compromised so as to potentially allow the blue laser light to escape outside, which can harm a living organism exposed to the blue laser light directly, or even indirectly. Accordingly, incorporating a blue laser light source into a luminaire for general illumination in a safe and optically efficient design is difficult.

Instead, most general illumination lighting therefore utilizes a group of series connected white LEDs of approximately the same brightness capacity mounted on a printed circuit board to form an LED based light engine. The LEDs are mounted on a printed circuit board, and assembly of a luminaire requires mounting of one or more secondary optics to process the light from the LEDs to produce a desired light output distribution. This approach, however, limits the types of light output distributions that can be produced by LED based luminaires, particularly without requiring complex and/or costly LED arrangements and circuit boards. For example, LED based luminaires utilize rigid printed circuit boards. Because of the large number of LEDs and attendant need for a larger circuit board, LED light engines are difficult to adapt to curved or irregular luminaire configurations.

If color tuning is desired, the light engine may include two or more groups of LEDs of different color characteristics, e.g. white (W) LEDs of two different color temperatures, three of more strings of different color LEDs (such as red (R), green (G) and blue (B) or combinations of white and colors, e.g. RGBW). The inclusion of multiple groups of different LEDs increases the number of LEDs on the circuit board, which increases the complexity of the layout of elements a connection traces on the board. The inclusion of multiple groups of different LEDs also increases the complexity of the control circuitry, for example to provide multiple channels of control for the different groups/types of LEDs.

As noted, LED based luminaires often include secondary optics to direct the light from the LEDs to provide a light output distribution suitable for the intended general illumination application of the luminaire. Most such luminaires are not tunable with respect to output distribution. Instead, luminaires intended for different applications, for example for a wall washing application as opposed to a downlight application, typically have different static secondary optics.

Dynamic variation of the light output distribution adds a still further degree of complexity and attendant cost. For example, one approach uses controlled variable secondary optics, which increases cost of the optic and requires additional control circuitry. Another approach utilizes multiple LEDs coupled through a complex passive lens, with different distributions based on operations of different ones of the LEDs thought different portions of the lens. The additional LEDs increase the complexity of the printed circuit board layout and require additional control channels from the driver circuitry.

As the number of LEDs increases, for tuning of color characteristic or tuning of output distribution, it becomes difficult to keep the luminaire compact, due to the size and number of the LEDs. As noted, the complexity of the printed board layout increases, and the requirement of more control channels increases the cost of the driver circuitry. Assembly time and cost also increase. The increased number of LEDs also raises thermal issues relating to dissipation of increased heat generated by more LEDs.

There is room for improvement in solid state lighting for general illumination to address some or all of the issues outlined above.

SUMMARY

The concepts disclosed herein provide improvements in luminaires for general illumination applications, and overcome some or all of the concerns outlined above.

An example luminaire includes a laser light source and different first and second holograms. In this example, means are provided for selectively applying a beam of light from the laser light source to the first hologram in a first state of the luminaire to enable the luminaire to output light of a first characteristic and to the second hologram in a second state of the luminaire to enable the luminaire to output light of a different second characteristic.

The difference in light output characteristic may relate to different color characteristic(s), e.g. if different output patterns from the two holograms excite different photoluminescent materials. In other examples, the difference in light output characteristic may relate to different distribution of light output from the luminaire in the different states, e.g. if different output patterns from the two holograms cause light output via different optics or different portions of a complex lens that provide the different output distributions.

A variety of examples of different means for selectively directing light from the laser to the two different holograms are disclosed below, and some are shown in the accompanying drawings. Just a few of those examples include: manual or automated mechanisms for moving a holographic optical element having the two different holograms, manual or automated mechanisms for moving a laser light source relative to a holographic optical element, a variable beam steering optic to selectively steer the beam of light from the laser light source to the different holograms, stacked gated or switchable holographic elements each having one of the holograms, and using two controllable laser emitters in the source with selective control of the emitters to emit a beam from one emitter to the first hologram in the first state and to emit a beam from the other emitter to the second hologram in the second state. If the holographic optical element has holograms selected by angles of incidence, other means may be used to change the angle of the laser beam and/or to change the angle of the holographic optical element. The skilled reader should appreciate that other means may be used for the selective direction of laser light to the holograms, particularly after review of the drawings and detailed descriptions of the examples below.

Another example luminaire includes a laser light source and a holographic optical element. The holographic optical element has first and second holograms configured to distribute a beam of light from the laser light source into different first and second patterns of light. The laser light source and the holographic optical element are configured relative to each other so that the beam of light from the laser light source can be selectively directed to the first of the holograms a first state of the luminaire. The laser light source and the holographic optical element also are configured relative to each other so that the beam of light can be directed to the second of the holograms in a second state of the luminaire. The example luminaire also includes first and second regions of at least one photoluminescent material. The first region of photoluminescent material is located so as to receive the first pattern of light from the first of the holograms in the first state of the luminaire, and the second region of photoluminescent material is located so as to receive the second pattern of light from the second of the holograms in the second state of the luminaire.

A further example luminaire includes a laser light source and a holographic optical element having first and second holograms. The holograms are configured to distribute a beam of light from the laser light source into different first and second patterns of light. The laser light source and the holographic optical element are configured relative to each other so that the beam of light from the laser light source can be selectively directed to the first of the holograms in a first state of the luminaire and directed to the second of the holograms in a second state of the luminaire. In this example, the luminaire also includes a first optic and a second optic configured to provide different output distributions for light outputs of the luminaire. The first optic is located so as to receive light based on the first pattern of light from the first of the holograms, in the first state of the luminaire. The second optic is located so as to receive light based on the second pattern of light from the second of the holograms, in the second state of the luminaire.

Another example luminaire includes a laser light source and a holographic optical element having first and second holograms. The holograms are configured to distribute a beam of light from the laser light source into different first and second patterns of light. The laser light source and the holographic optical element are configured relative to each other so that the beam of light from the laser light source can be selectively directed to the first of the holograms in a first state of the luminaire and directed to the second of the holograms in a second state of the luminaire. In this example, the luminaire also includes a passive lens formed of a solid transparent material. The passive lens includes a compound input surface having different surface portions optically coupled to receive light based on the first pattern of light from the first of the holograms in the first state of the luminaire and to receive light based on the second pattern of light from the second of the holograms in the second state of the luminaire. The passive lens further includes a compound output surface having different surface portions to output light with a first distribution in the first state of the luminaire and to output light with a second distribution in the second state of the luminaire.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations, by way of example only, not by way of limitations. In the figures, like reference numerals refer to the same or similar elements.

FIGS. 23 to 26 are plan views of examples of phosphor type photoluminescent materials distributed on differently shaped substrates, for use in tunable laser-based lighting devices.

FIG. 33 is a high-level functional block diagram of a smart implementation of a lighting device, which utilizes a laser light source, a holographic optical element, a photoluminscennt material and an optical system as in one of the earlier tunable luminaire examples.

DETAILED DESCRIPTION

Figure 1:
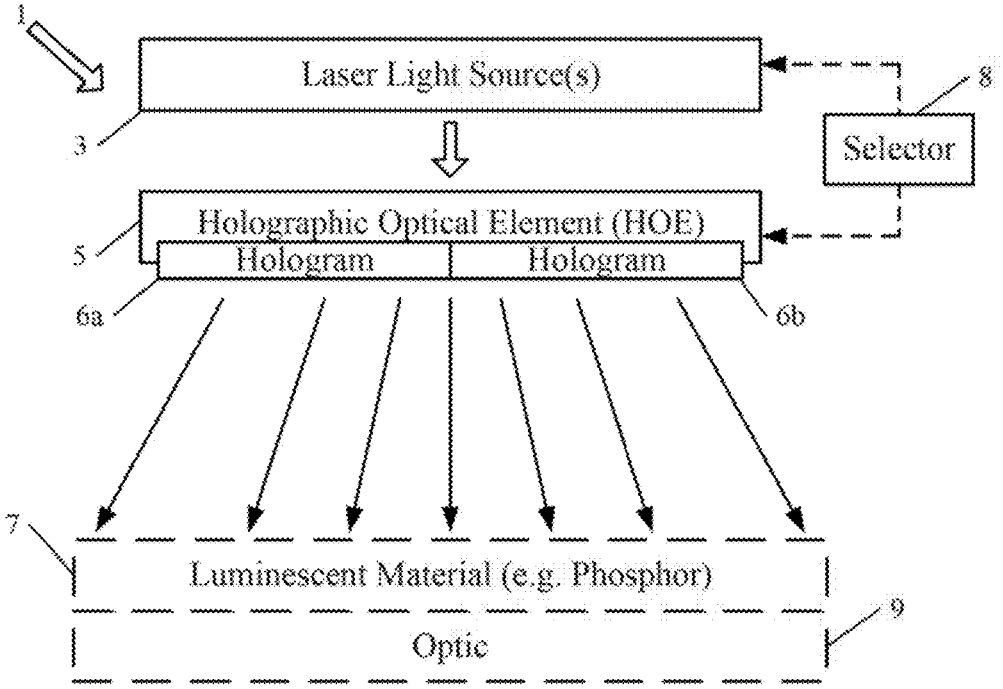
FIG. 1 is a high-level functional block diagram of an example of a laser-based luminaire with a dynamically variable operational characteristic.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Many of the constraints found in dynamically tunable luminaire designs that utilize LED based light sources result from the need for an array of point emitters (the LEDs) across a flat printed circuit board, particularly if increased numbers of LEDs and associated driver circuits/channels are needed to implement a desired tunable functionality. Hence, there is room for improvement in solid state lighting for general illumination to address some or all of the issues outlined above. It may be advantageous to provide simpler tunable artificial lighting without the need for such complex optics, large number of included solid state emitters, large printed circuit boards, etc. Lasers are utilized in the examples discussed below to address some or all of the issues of concern; and in such examples, the arrangement of the laser light source and any optic (if provided) should be well suited to general illumination but without the drawbacks associated with the secondary optics (e.g. without necessarily requiring a complex arrangement or numbers of mirrors to deflect the laser light) in laser based lighting equipment for vehicle applications.

The various examples disclosed herein relate to tunable luminaires for general lighting applications that include laser light sources, holographic elements and photoluminescent materials. In such an example luminaire, the holographic optical element has first and second holograms. Those holograms, for example, may be configured to distribute light from a beam from a laser light source into different first and second patterns of light. Light of a beam from the laser light source is selectively directed to expose a first one of the holograms in a first state of the luminaire to configure the luminaire to output light of a first characteristic and to expose a second one of the holograms in a second state of the luminaire to configure the luminaire to output light of a different second characteristic.

In some of the specific operational examples, the laser light source and the holographic optical element are configured relative to each other so that the beam of light from the laser light source can be selectively directed to the first of the holograms but not the second of the holograms in a first state of the luminaire. In such examples, the laser light source and the holographic optical element also are configured relative to each other so that the beam of light can be directed to the second of the holograms but not to the first of the holograms in a second state of the luminaire. Other luminaire states may allow overlap of laser light on some or all of both holograms.

The different output characteristic in the different luminaire states may relate to a number of different lighting parameters of interest in adjustable or tunable general illumination applications. Some examples described in detail below provide illumination light output with a difference in a color characteristic in the different luminaire states, other examples provide illumination light output with a difference in illumination light output distribution in the different luminaire states, and some examples may provide differences both in color characteristic and in output distribution. Of course, other tunable characteristics may be provided, e.g. different information content presentation in different states of a luminaire for a signage application.

An example luminaire may also include first and second regions of at least one photoluminescent material. The first region of photoluminescent material is located so as to receive the first pattern of light from the first of the holograms in the first state of the luminaire, and the second region of photoluminescent material is located so as to receive the second pattern of light from the second of the holograms in the second state of the luminaire.

Alternatively or in addition to the photoluminescent material, an example luminaire may include a first optic and a second optic configured to provide different output distributions for light outputs of the luminaire. The first optic is located so as to receive light based on the first pattern of light from the first of the holograms, in the first state of the luminaire. The second optic is located so as to receive light based on the second pattern of light from the second of the holograms, in the second state of the luminaire.

The term "luminaire," as used herein, is intended to encompass essentially any type of lamp, light fixture or the like that includes a laser light source that processes energy to generate or supply the laser beam(s) used via the holograms and photoluminescent material and/or optic(s) to generate the artificial light, for example, for a general illumination application in a space intended for a use such as occupancy or observation, typically by a living organism that can take advantage of or be affected in some desired manner by the light emitted from the luminaire. However, a tunable laser-based luminaire may provide light for use by automated equipment, such as sensors/monitors, robots, etc. that may occupy or observe the illuminated space, instead of or in addition to light provided for an organism. However, it is also possible that one or more dynamic laser-based luminaires in or on a particular premises serve other general lighting applications, such as signage for an entrance or to indicate an exit. In most examples, the luminaire(s) illuminate a space or area of a premises to a level useful for a human in or passing through the space, e.g. general illumination of a room or corridor in a building or of an outdoor space such as a street, sidewalk, parking lot or performance venue, or for observation of the information of a sign, etc. In many of the examples, the laser light source pumps a photoluminescent material to provide white light output from the luminaire of intensity and/or color characteristic(s) suitable for the particular general illumination application of the luminaire. The actual laser light source in the luminaire may be any type of laser light emitting device, several examples of which are included in the discussions below.

A tunable laser-based lighting device or system for a general lighting application includes elements similar to those of the laser-based luminaire, e.g. the laser light source, the holographic optical element, and possibly the photoluminescent material and/or an optical system, although such a lighting device or system may also include other elements. Examples of such other elements include the drive circuitry to operate the emitter or emitters of the laser light source, drive circuitry for any other controllable elements of the luminaire for tuning purposes, any associated processor or the like to control the source or other controllable elements via the applicable driver circuit(s), and possibly one or more communication interfaces and/or one or more sensors.

Terms such as luminaire, lighting device and/or lighting system, as used herein, are intended to encompass essentially any type of laser-based lighting equipment for a general lighting type application that incorporates the laser light source, holographic optical element, and if provided, the photoluminescent material or secondary optic(s). A luminaire, for example, may take the form of a lamp, light fixture, or the like, which by itself contains no intelligence or communication capability. The illumination light output of an artificial illumination type luminaire, lighting device or lighting system, for example, may have an intensity and/or other characteristic(s) that satisfy an industry acceptable performance standard for a particular general lighting application.

The term "coupled" as used herein broadly encompasses both physical or mechanical type structural connection between elements as well as any logical, optical, physical or electrical connection, link or the like by which signals or light produced or supplied by one element are imparted to another coupled element. Unless described otherwise, coupled elements or devices are not necessarily directly connected to one another and may be separated by intermediate components, elements, communication media, etc.

Light output from the luminaire, lighting device or lighting system may carry information, such as a code (e.g. to identify a luminaire or its location) or downstream transmission of communication signaling and/or user data. The light based data transmission may involve modulation or otherwise adjusting parameters (e.g. intensity, color characteristic or distribution) of the illumination light output from the device.

As noted, blue laser light sources have been utilized in automobile headlamp applications. A lighting device configured for a vehicle application such as a headlamp, however, typically is not commercially viable for a general lighting application, therefore a laser-based vehicle lighting device is not readily adaptable for a general lighting application. It may be helpful to consider several examples of distinctions, one or more of which may be present in the laser based general lighting equipment examples described in more detail below. For example, power ranges are more flexible for laser based general lighting. General lighting devices using a laser based luminaire usually can be attached to the electricity grid while vehicle laser headlamps rely on a vehicle battery and power generator. This electrical distinction offers more power, for example, for much larger luminous flux output for general laser lighting. As another example, there is a size limitation for laser-based vehicle headlamps to enable mounting thereof in the conventional headlamp spaces on the front of the vehicle approximately on opposite sides of the crowded engine room. However, a laser based luminaire for general lighting has no such size limitation allowing a more flexible laser source arrangement in general laser lighting (mechanical/geometrical distinction). Furthermore, a headlamp typically provides a relatively thin slab light distribution in front of the vehicle and extending only as far above the road surface as optimal for driver visibility of objects generally in front of the vehicle. Stated another way, a main purpose of vehicle lighting is to illuminate oncoming objects, such as static signs along the street and pedestrians crossing or walking along the street. Hence, an optimal light distribution of headlamps is quite flat (restricted in the height dimension of the light output). On the other hand, General lighting need not be so restricted for light output distribution; and for many general lighting applications, an optimized two-dimensional lighting distribution at a certain distance is preferred, e.g. having an intended intensity distribution over a designated area of a plane onto which the luminaire projects general illumination light (optical distinction). Also, the color quality of light output for a vehicle lighting application, such as a headlamp, is not that important. For most general lighting applications, designers and occupants care about color quality metrics of light, such as coordinated color temperature (CCT) or color rendering index (CRI). Example general lighting luminaires described below typically include photoluminescent material optimized to produce a desirable color quality in the luminaire output light (chromatic distinction). Also, the intended color characteristic may be changed for different users or applications by use of a different photoluminescent material, either in different versions of the luminaire or dynamically by switching which photoluminescent material is exposed/pumped in different states of a tunable laser based luminaire.

Reference now is made in detail to the examples illustrated in the accompanying drawings and discussed below. FIG. 1 depicts a tunable or dynamically variable laser-based luminaire 1, in high-level functional block diagram form. In the example, the luminaire 1 includes a laser light source 3 and a holographic optical element 5. The holographic optical element (HOE) 5 has a number of different holograms optically coupled to receive a beam of light from the laser light source 3. Although there may be more holograms, the drawing shows an example in which the holographic optical element 5 has two different holograms 6*a*, 6*b*. Each hologram 6*a*, 6*b* is configured to distribute light received from the laser light source 3 as a different pattern of light.

The holographic optical element 5 carrying multiple holograms may be a relatively small, light-weight component. The spot of the laser beam on the holographic optical element 5 may be less than 1 mm in diameter if round (or largest dimension if oval or the like). Hence, each hologram may have an area around 1 $mm^2$. A holographic optical element with an array of holograms, for example may have an area around 1 $cm^2$. Smaller sizes for the holographic optical element 5 may be suitable if the element carries a small number of holograms.

The luminaire 1 optionally may also include one or more elements or systems (alone or in combination) for optically processing light patterns from the two different holograms 6*a*, 6*b*. FIG. 1 shows two such optional additional items (in dashed line form), including a photoluminescent material 7 and at least one output optic 9, sometimes referred to as a secondary (2nd) optic with regard to some later illustrations. The holograms 6*a*, 6*b*, which are optically coupled to selectively receive a beam of light from the laser light source 3 in different states of the luminaire 1, provide selectable different projection patterns of light on the photoluminescent material 7 and/or to different areas or optic elements of the optic 9. In simple examples where the holograms are intended to select different photoluminescent materials but not different optical elements, the optic 9 may be simple pass-through element, such as a relatively transparent plate, a filter, or the like; or the optic 9 may be a lens of any suitable type (e.g. concave, convex, plano convex, etc.), a holographic lens, an array of lens, one or more mirrors, a grating, a lenslet film, or the like. In examples in which holograms are intended to select different optical elements of different characteristics in the different luminaire states, the optic 9 may include multiple lenses holographic lenses of different characteristics, two or more different arrays of lenses or mirrors, two or more gratings, or the like. A variety of examples of the optic 9 are shown in later drawings discussed in more detail below.

The examples utilize selective laser projection from a hologram 6*a* or 6*b* or via a combination of holograms 6*a* and 6*b* provided on the element 5 to tune at least one characteristic of light output from the luminaire 1. Each hologram, for example, may take the form of an interference pattern varying in surface profile, density and/or opacity design to produce a desired three-dimensional light output field when appropriately illuminated. Such a hologram may be a two-dimensional pattern or a three-dimensional pattern formed on or in the holographic optical element.

The holograms may be provided on or in one or more holographic optical elements in a variety of ways. For example, holograms may be embedded in a carrier or substrate of one or more material layers. In other examples, a variable material, such as a liquid crystal layer, may be configured to act as a defined hologram in at least one selectable state. For convenience of illustration and discussion, in most of the examples including the example of FIG. 1, a holographic optical element (e.g. element 5) is produced by imprinting an interference pattern of one or more of the holograms 6*a*, 6*b* on a surface of a suitable material.

The material may be reflective or transmissive. FIG. 1 shows a transmissive holographic optical element 5 in that the projection of output light is via an output surface of the element 5 opposite the input surface (with the output of light forming a holographic projection having passed or been transmitted through the holographic optical element). Examples of luminaires using reflective holographic optical elements are described later.

The holographic optical element 5 carrying the holograms 6*a* and 6*b* may be a relatively small, light-weight component. The spot of the laser beam on the holographic optical element 5 may be less than 1 mm in diameter if round (or largest dimension if oval or the like). Hence, each of the holograms 6*a* or 6*b* may have an area around 1 $mm^2$, although larger or smaller holograms may be used.

A hologram 6*a* or 6*b* may be designed and imprinted on the substrate surface of the holographic element 5 in a variety of ways. It may be helpful to consider a particular example design technique. Computer aided design of each hologram 6*a* or 6*b* on a substrate surface of element 5 can produce a variety of two or more selectable optical processing capabilities. The substrate for the hologram may be reflective or transmissive (e.g. substantially transparent). Various imprinted computer generated holographic images may be configured as beam splitters or distributors for sending light from an input beam in various patterned distributions, as lenses of particular properties, as light filters, as diffraction gratings, etc. In a beam splitter application, for example, different elements or regions of one element carrying different holograms 6*a*, 6*b* distribute light from a laser beam in different patterns. For a luminaire application, design of the luminaire includes specification of a projection pattern from each hologram for the different states of the luminaire 1, and a computer implemented hologram design procedure is used to generate a corresponding hologram 6*a* or 6*b* and imprint the hologram at a suitable location on the substrate of element 5, such that each hologram 6*a* or 6*b* is configured to distribute light from a laser beam in the respective specified pattern.

A laser beam produces a single spot of illumination, in this case on a region of a holographic optical element 5. Using a hologram 6*a* or 6*b* configured for beam splitting, the respective hologram may be computer-designed to split the beam into any selected number of lower power beams directed in selected directions. More continuous distributions of light from the hologram are also possible. The patterns of the directed light outputs from the holographic optical element 5 can have any shapes that may be defined by configuration of the computer generated holograms 6*a*, 6*b*, e.g. for a circular pattern of spots on a substrate having a phosphor in or formed on the substrate, a rectangular or square array on such a phosphor substrate, rings of spots, etc. A beam splitting hologram also may be tailored to define the shape of each output beam, e.g. to produce a square spot, a trapezoidal spot, etc., instead of just round or oval spot. As a result, the distribution of light need not be limited to that provided by a round, rectangular or square array of point sources as in typical LED based luminaires or an array of emitters mounted on a flat circuit board.

The laser light source 3 can be any laser emitting device of sufficient power, which emits light of a nominal wavelength and light of wavelengths typically in a relatively narrow wavelength band around the nominal wavelength. For example, the laser light source 3 may be a gas laser, a fiber laser, a laser array, or one or more laser diodes. The laser source may also utilize second or higher order harmonic conversion.

The laser light source 3 in the example with material 7 is chosen to emit light of wavelength(s) to optically pump a particular type of photoluminescent material 7 so as to produce light output from the luminaire of a spectral power distribution (or other color characteristic) suitable for a particular illumination application of the luminaire 1. The laser light source 3 alone or in combination with a particular photoluminescent material 7 also is/are engineered to provide an output intensity for the luminaire 1, as distributed over an intended output distribution, where the output intensity is suitable to the particular illumination application of the luminaire 1.

Laser light source 3 is configured to be driven by electrical power to emit the laser light toward the holographic optical element 5. The laser light source is driven, for example, by power from a laser light source driver (see 111 in FIG. 33) coupled to the laser light source 3 to selectively control the laser light source 3 to emit the beam directed to the holographic optical element 5. Although other laser light sources may be used, the examples herein typically utilize one or more laser diodes to implement the laser light source 3.

In many examples, the light from the laser light source 3 is a blue or ultraviolet laser beam, and the photoluminescent material 7 is a phosphor or mix of phosphors to convert the blue or ultraviolet light to longer wavelength light of wavelengths with a net spectral power distribution such that the net light output appears to be white. Different phosphors or combinations of phosphors can produce white light of different color characteristics, e.g. different correlated color temperature (CCT), color rendering index (CRI), R9 etc., or to produce overall output light of a different non-white color characteristic. In some examples, light of the different patterns from the two holograms 6*a*, 6*b* illuminate regions within the material 7 having different phosphors to produce output light having a difference in one or more of the color characteristics in the different states of the luminaire. In other examples, light of the different patterns from the two holograms 6*a*, 6*b* illuminate regions within the same phosphor material 7 coupled to different secondary optics providing different output distributions in the different states of the luminaire.

A blue/ultraviolet laser light source 3 may be a laser diode fabricated with aluminum-indium-gallium-nitride-based (AlInGaN-based) semiconductors, which produce blue/ultraviolet light without frequency doubling. The laser light source 3 emits the laser beam toward the holographic optical element 5 with a nominal wavelength shorter than 500 nanometer (nm). For blue light emissions, the laser light may have a nominal wavelength between 445 nm through 465 nm, including the "true blue" wavelength of 445-450 nm. The 445-465 nm wavelength laser light is closer to the peak sensitivity of the human eye and therefore appears brighter than 405 nm violet laser diode light sources. However, in some examples, the laser light source 3 can be included in a luminaire 1 that emits electromagnetic radiation between 249-480 nm, which covers ultraviolet, violet or blue wavelengths. Electrically-pumped lasing from an AlGaInN-based quantum-well at room temperature can occur as low as the 249 nm wavelength. In some examples, laser light source 3 may emit electromagnetic radiation in the infrared wavelength. Typically, the laser light from source 3 forms a laser light spot incident on the input surface of the holographic optical element 5 in the shape of an oval shape with a Gaussian distribution.

A transmissive phosphor serving as the photoluminescent material 7, for example, may output illumination lighting with a correlated color temperature of around 5100 Kelvin white. Other correlated color temperatures, from warm white to cool white, may be derived by tuning phosphor formula, for example, at the different regions of material 7 illuminated by the different patterns projected by the different holograms 6*a*, 6*b* in the different states of the luminaire 1. The luminance of the transmissive phosphor when utilizing a laser light source 3 as the light pumping source can reach hundreds of candela/square millimeter, which is at least 10 times the luminance that a light emitting diode (LED) light source generates.

As outlined above, the luminaire 1 includes a laser light source 3 and a holographic optical element 5 with different first and second holograms 6*a*, 6*b* configured to provide different patterns of light when exposed to light from the laser light source 3. Various means may be used to selectively direct a beam of light from the laser light source 3 to the first hologram 6*a* in a first state of the luminaire 1 to enable the luminaire to output light of a first characteristic (e.g. a first color characteristic or a first output distribution or a first combination thereof) and selectively direct a beam of light from the laser light source 3 to the second hologram 6*b* in a second state of the luminaire 1 to enable the luminaire to output light of a different second characteristic (e.g. a different/second color characteristic or a different/second output distribution or a different/second combination thereof). Such a means for selective direction/coupling of laser light to the different holograms 6*a*, 6*b* is represented by the selector 8 in FIG. 1.

A variety of examples of different technologies to implement the selector 8 for selectively directing light from the laser source 3 to the two different holograms 6*a*, 6*b* may be used. Selection may involve a manipulation of the holographic optical element 5 as represented by the dashed line arrow from the selector 8 to the holographic optical element 5, and/or a manipulation of the actual laser device(s) in the source 3 or a direction of a beam from the source 3 as represented generally by the dashed line arrow from the selector 8 to the laser light source 3.

Some examples described more fully below and shown in several later drawings manipulate the holograms relative to a fixed laser beam, as generally represented by the dashed arrow from selector 8 to the holographic optical element 5. Luminaires implementing a mechanical position selector approach may utilize manual or automated mechanisms for moving a holographic optical element 5 or the laser light source 3 and thus which of the two different holograms 6*a*, 6*b* is exposed to receive the beam from the laser light source 3 in the different luminaire states. Luminaires implementing a more electronic approach to hologram selection may utilize stacked gated or switchable holographic elements collectively forming element 5, where each gated or switchable element has one of the holograms, and the exposed hologram 6*a* or 6*b* is selected by selective operation of one or more of the gates.

Other examples described more fully below and shown in several later drawings manipulate the beam from the laser light source 3 relative to a fixed-position holographic optical element 5 as represented by the dashed line arrow from the selector 8 to the laser light source 3. Some examples of luminaire 1 utilizing this later approach for a selector 8 may include a variable beam steering optic to selectively steer the beam of light from the laser light source 3 to the different holograms 6*a*, 6*b*. Other examples of the luminaire 1 utilizing laser beam control may include multiple laser emitters in the source 3 aimed respectively at the different holograms 6*a*, 6*b*, and selective operation of such emitters selectively exposes the holograms 6*a*, 6*b* in the different luminaire states.

In many of the illustrated examples, regions of holographic optical elements bearing the holograms are shown as separate surface regions, for convenience; and in those examples, the selections of different holograms involve selective exposure of the different surface regions. The holograms, however, may be imprinted on or embedded in one or more regions of the material of the holographic optical element in other ways and selectively exposed to laser light by other types of movement of the element or the beam. For example, the holographic optical element may carry holograms at different orientations so that a different hologram is selectively exposed based on a difference in angle of incidence of the laser beam relative to the holographic optical element. Hologram selection using such an angle sensitive element may be implemented in a variety of ways, similar to those of other selection examples. For example, the optical element with the holograms selectable at different angles may be rotated to change angle relative to a fixed laser light source, or the laser light source may be moved to apply the light beam at a different angle. In another alternative example, the luminaire may include two or more laser emitters located and oriented to direct laser beams at the element at different exposure angles; and the holograms are selected by selections of which of the laser emitters is operated in each of the states of the luminaire.

The skilled reader should appreciate that other selectors 8 may be used for the selective direction of laser light to the holograms 6*a*, 6*b*, particularly after review of the later drawings and the detailed descriptions of the examples below.

The laser-based luminaires disclosed herein may have one or more advantages over traditional solid state lighting using LEDs. Several potential advantages are discussed below by way of non-limiting examples.

The laser beam provides a smaller light spot output than an LED. As a result, processing of the beam allows use of more compact, lighter optics. Smaller optics may lower cost, and/or the luminaire may be lower in overall weight.

An LED based approach uses an array of LEDs spaced apart on a printed circuit board. The shape of the board and the array determines the shape of the light supplied from the array. The spacing between the LEDs on the board may cause pixilation. By contrast, laser projection via a hologram can provide virtually any desired light distribution, as determined by the particular hologram. Also, the hologram may be designed to provide light distribution, e.g. onto the photoluminescent material, that is free of perceptible pixilation.

The shape of the distribution may be configured to conform to the intended design of a particular luminaire. For example, a hologram may be designed to provide a circular distribution for a circular luminaire (e.g. a circular downlight), a hologram may be designed to provide a square or other rectangular distribution for a square or other rectangular luminaire (e.g. a 2×2 luminaire or a 2×4 luminaire), a hologram may be designed to provide a triangular distribution for a triangular luminaire, etc.

The preceding shape examples are two dimensional distribution configurations. The laser projection, however, may also enable adaptation to desired three dimensional distributions. The LED approach typically requires a flat printed circuit board or sections of flat printed circuit boards, and such circuit board requirements complicate the design and manufacture of curved panel luminaire panel. The laser projection approach however is readily adaptable to a curved surface of the luminaire, e.g. of a phosphor substrate and/or an optical output surface of the luminaire. The LED light decreases in proportion to the square of the distance from each respective LED. Because it is coherent, a laser beam does not significantly disperse and therefore does not decrease in power density as rapidly as a function of distance from the emitter, particularly over the relatively short distances between the laser light source and the actual final output, as would be typical in luminaire architectures. Consequently, the light of the laser projection can be distributed over a desired flat or curved surface even if the plane or the curvature of the surface causes a variation in distance from the laser to points on the surface, without undesired differences in light intensity applied across the particular surface. Where differences are desirable, however, the hologram can be designed to provide different light intensity to different points or regions on the particular surface, regardless of uniformity or differences in distance from the laser light source.

In LED based luminaires, cost tends to be proportional to the number of LEDs. For example, more LEDs may be required for added intensity or for implementation of controllable distribution or controllable color characteristics/In addition to the cost of using more LEDs, increasing the number of LEDs requires more complex circuit board layout, more lead connections or traces on the board and more complex driver hardware to operate the increased numbers/channels of LEDs. Luminaires using a laser light source and holograms are more readily adaptable to various luminaire designs and applications, in some cases, with only the need to change to different holograms. Typically, a diode based example of the laser light source will utilize a smaller number of diodes than a LED based source, and the laser light engine scales to meet the requirements of a variety of applications without such a rapid increase in the number of emitter diodes. Support for a tunable operation in a laser-based luminaire need not add so many more emitters, and many of the variations only require one or more additional holograms on the holographic optical element and possibly additional regions/sub-regions of photoluminescent materials and/or additional optical elements.

FIG. 1 and many of the illustrations of the later examples show luminaries oriented so that the overall light emissions are directed generally downward into a space to be illuminated. Such a downlight configuration, for task lighting or other similar general illumination applications, is given only as a non-limiting example. Light fixtures or other types of luminaires in the examples may be at any location and/or orientation relative to the space, structural surfaces or any objects or expected occupants to support a desired general lighting application appropriate for the usage or purpose intended for the space that will be illuminated. For example, downlight fixtures provide direct lighting from above. As other examples, indirect lighting may reflect light off of a ceiling or wall surface, or the lighting may principally illuminate an object in the room to be viewed by the occupants. As another example, a wall wash or wall grazing application might utilize a luminaire directed downward or upward at an angle relative to a surface of the wall of the like that a luminaire is intended to illuminate.

Figure 2:
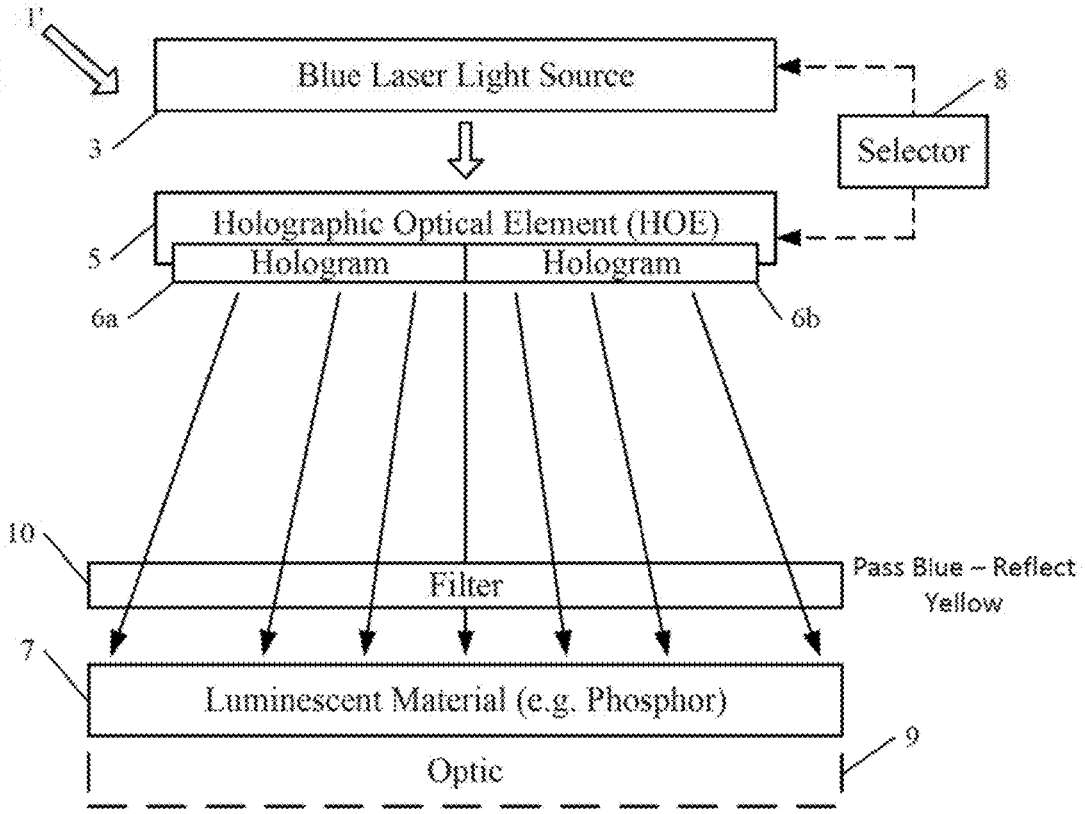
FIG. 2 is a high-level functional block diagram of another example of a luminaire, similar to that of FIG. 1 but with an added filter.

FIG. 2 shows an example luminaire 1' similar to the luminaire 1 of FIG. 1; and the same reference numbers are used to identify the elements of luminaire 1' that are essentially the same as the similarly numbered elements of luminaire 1. The luminaire 1' includes the photoluminescent material 7, and the luminaire 1' may include an optic 9.

The luminaire 1' includes an additional filter 10 between the holographic optical element 5 and the photoluminescent material 7. The filter 10 is an optical element configured to pass light at least of the wavelengths included in the beam from the laser light source 3 (e.g. in a blue wavelength range or in an ultraviolet wavelength range) as split and/or distributed by at least one of the holograms 6*a* or 6*b* toward the photoluminescent material 7. The filter 10 also is configured to reflect at least some light produced by the photoluminescent material 7 that may be emitted from material 7 toward the holographic optical element 5. The filter 10 reflects such light back through the photoluminescent material 7 toward the luminaire output (e.g. through the optic 9). The light reflection provided by the filter 10 improves the output efficiency of the luminaire 1'.

In an example luminaire using a blue laser light source 3, the filter 10 may be a dichroic filter configured to pass blue light received in the direction from the holographic optical element 5 and reflect yellow light produced by the photoluminescent material 7 that the filter may receive in the direction from the material 7. In another approach, the filter 10 may be a holographic spectral selective mirror oriented to pass light coming in the direction from the holographic optical element 5 and reflect light of the phosphor emission spectrum from the photoluminescent material 7 back toward the material 7 and the output of the luminaire 1'.

Although shown in only the one drawing for convenience, a filter like filter 9 of FIG. 2 may be provided in any of the other examples described herein.

Figure 3:
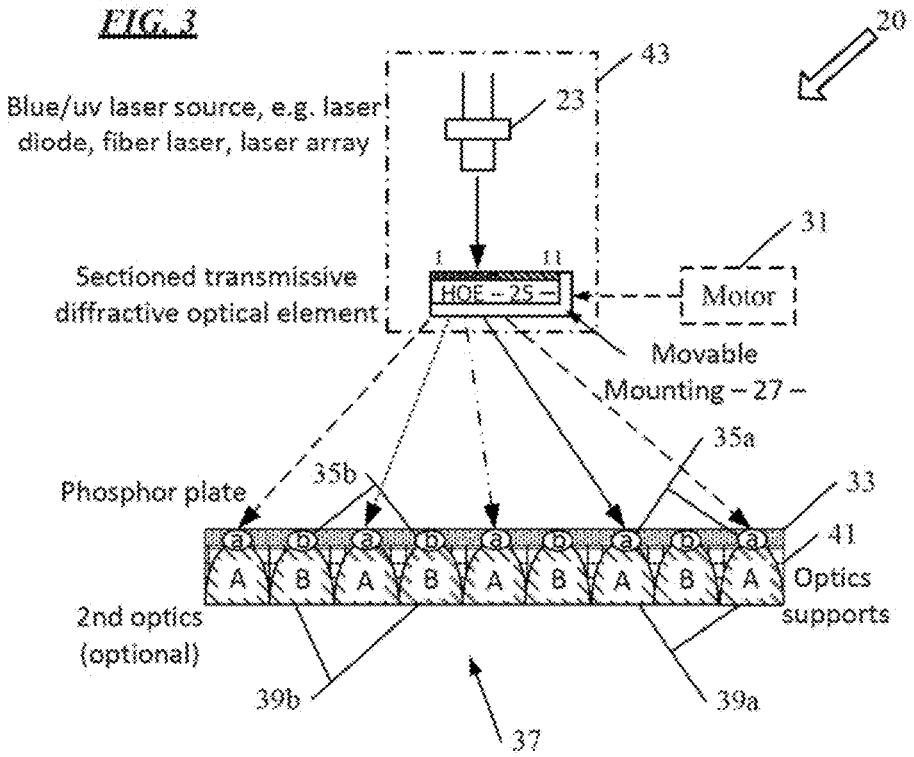
FIG. 3 is a side/partial cross-sectional view of a first more specific example of a tunable laser-based luminaire, in a first state.
Figure 5:
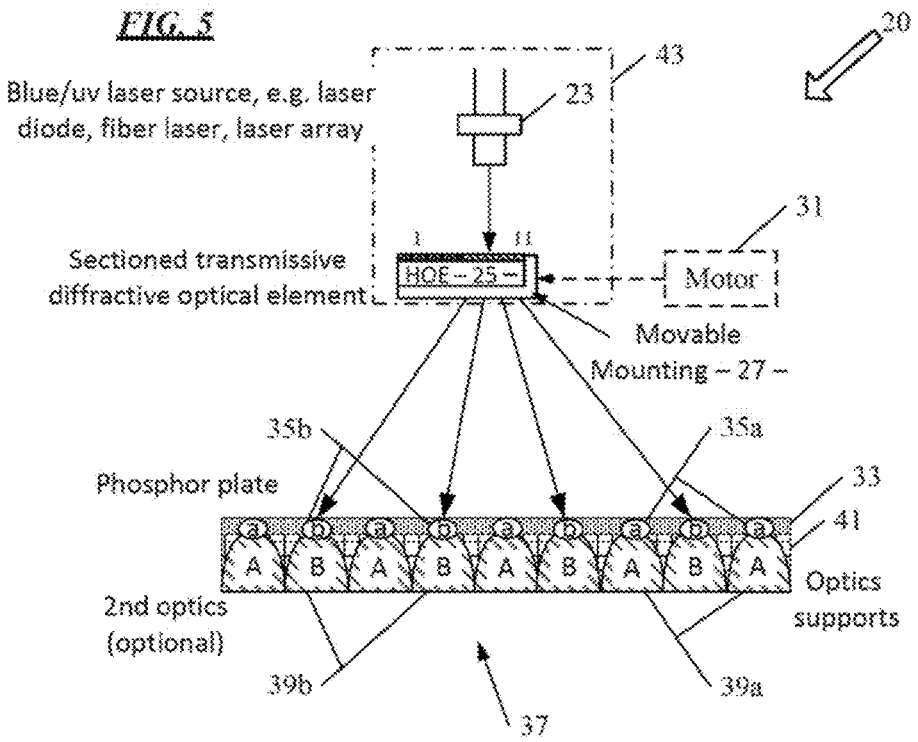
FIG. 5 and FIGS. 6A to 6C are views of the luminaire and examples of the different holographic optical elements of FIGS. 3 to 4C, respectively, but shown in the second luminaire state.

FIG. 3 is a side/partial cross-sectional view of an example of a tunable laser-based luminaire 20, in a first state; and FIG. 5 is a side/partial cross-sectional view of the tunable laser-based luminaire 20, in a second state. As discussed earlier, the laser light source may be any suitable laser light emitting device or combination of devices, such as a gas laser, a fiber laser, a laser array, or one or more laser diodes. The laser source may also utilize second or higher order harmonic conversion. In the example of FIGS. 3 and 5, the source emits blue or ultraviolet (UV) laser light.

For convenience of illustration and discussion of this example, the tunable laser based luminaire 20 includes a laser light source in the form of a laser diode 23. The luminaire 20 also includes a sectioned transmissive diffractive holographic optical element (HOE) 25 having a first hologram (I) and a second hologram (II) in respective holographic regions of the element 25. Although shown as different holograms or different portions, the elements 25 may carry one overall hologram incorporating different portions serving as the two different holograms.

In each of the different holographic regions of element 25, the hologram I or II is configured to divide a beam of light from the laser diode 23 of the light source into a different one of two patterns of light. For example, the two regions may carry two different diffractive beam splitting holograms to produce two different patterns of output beams. As shown in FIGS. 3 and 5, each of the holograms may split the blue or ultraviolet light into patterns of differently directed beams (represented by arrows in different angular directions). One hologram produces one beam distribution pattern (different beam angles), and the other hologram produces another angular beam distribution pattern.

One or both of the holograms may produce beams of approximately the same relative intensity as represented by the solid arrows in FIG. 5. Alternatively, either one or both of the holograms may produce beams of different relative intensities, as shown in FIG. 3, where two solid line arrows represent two beams of a relatively higher intensity, two dashed arrows represent two beams of moderate intensity, and a dashed-double dotted arrow represents a beam of relatively lower intensity. In the example states of FIGS. 3 and 5, the different beam intensities in the state shown in FIG. 3 may provide different output illumination intensities across the output surface of the luminaire 20, whereas the relatively similar beam intensities in the state shown in FIG. 5 may produce a more uniform output illumination intensity across the output surface of the luminaire 20. The numbers and intensities of the beams in the different patterns from the holograms I, II are given by way of non-limiting examples, and other numbers and/or relative intensities may be produced by appropriate holograms adapted for particular illumination applications.

As shown in FIG. 3, the laser light source formed by laser diode 23 and the holographic optical element 25 are configured relative to each other so that the beam of light from the laser diode 25 can be selectively directed to the first of the holographic regions containing hologram I but not the second of the holographic regions containing hologram II, in a first state of the luminaire. As shown in FIG. 5, the laser light source formed by laser diode 23 and the holographic optical element 25 are configured relative to each other so that the beam of light from the laser diode 25 can be selectively directed to the second of the holographic regions containing hologram II but not the first of the holographic regions containing hologram I, in a second state of the luminaire. Other states, such as a state directing the beam to one or more additional holograms or a state directing the beam so that a beam spot on element 25 overlaps two holograms, also may be supported.

The example luminaire 20 implements a mechanical position selector approach. For that purpose, the luminaire 20 includes a movable mounting 27 for the holographic optical element 25.

Figure 4B:
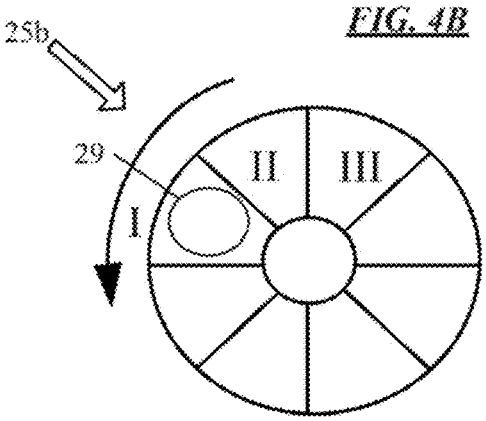
FIGS. 4A to 4C are plan views of several different examples of holographic optical elements having two or more regions with different holograms, as may be used in the luminaire of FIG. 3, and shown as exposed in the first luminaire state.
Figure 4A:
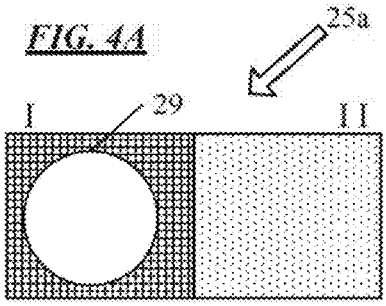
Figure 6B:
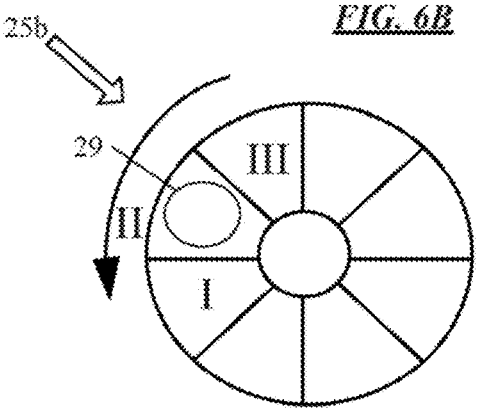
Figure 6A:
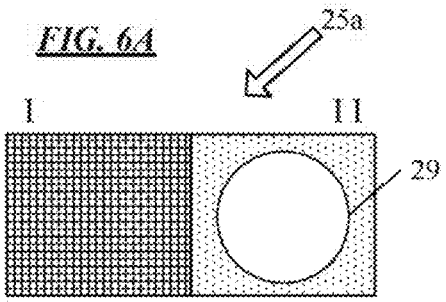

FIGS. 4A and 6A, for example, show the states of a rectangular holographic optical element 25*a* supporting the holograms I, II in two adjacent regions. For such a holographic element 25*a*, the movable mounting 27 would enable side to side movement (in the orientation of FIGS. 3 and 5) between two positions exposing the different holograms to the beam spot 29 in the two different states. In FIG. 4A, the holographic optical element 25*a* is positioned so that the beam spot 29 is received on the hologram I (but not hologram II), in the first state of the luminaire 20 (see also FIG. 3). In FIG. 6A, the holographic optical element 25*a* has been moved sideways so that the beam spot 29 is received on the hologram II (but not hologram I), in the second state of the luminaire 20 (see also FIG. 5). Additional holograms may be provided to support additional states of the tunable luminaire 20.

By way of another example, FIGS. 4B and 6B show two states of a circular disc implementation of a holographic optical element 25*b* supporting holograms I, II and III, and possibly more holograms, in wedge shaped regions of the disc. For such a holographic element 25*b*, the movable mounting 27 would enable rotational movement (about the vertical axis in the orientation of FIGS. 3 and 5) between positions exposing the different holograms to the beam spot in the two or more different states. In FIG. 4B, the holographic optical element 25*b* is positioned so that the beam spot 29 is received on the hologram I (but not hologram II), in the first state of the luminaire 20 (see also FIG. 3). In FIG. 6B, the holographic optical element 25*b* has been rotated (counter clockwise in the example) so that the beam spot 29 is received on the hologram II (but not hologram I), in the second state of the luminaire 20 (see also FIG. 5). Additional holograms may be provided to support additional states of the tunable luminaire 20.

Figure 4C:
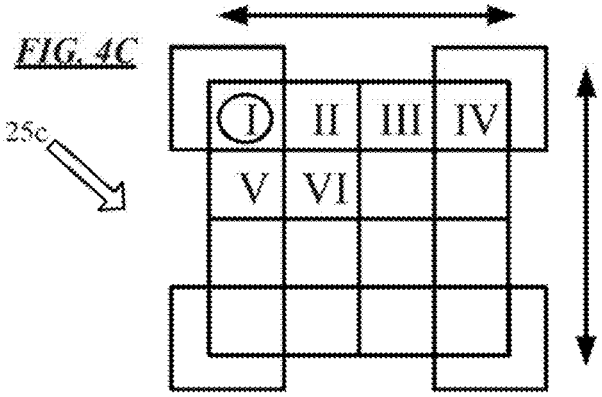
Figure 6C:
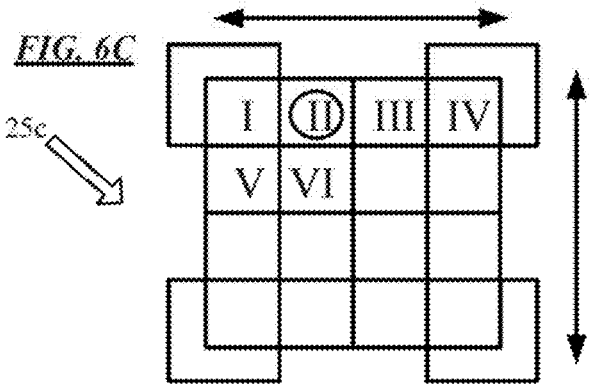

By way of a further example, FIGS. 4C and 6C show two states of a square holographic optical element 25*c* supporting an array of holograms I to VI and regions for more holograms if desired. In this example, each hologram is in a square shaped regions of the element 25*c*. The number of rows and columns of regions/holograms in the array are given by way of non-limiting example only; and fewer or more rows and columns may be provided. Also, the example array has the same number or rows as columns, but arrangements with more rows or columns, respectively than columns or rows may be utilized. For a holographic element 25*c*, the movable mounting 27 would enable lateral and longitudinal movement (in two orthogonal directions) as indicated by the two-way arrows in FIGS. 4C and 6C between positions exposing the different holograms to the beam spot in two or more different states. In FIG. 4C, the holographic optical element 25*b* is positioned so that the beam spot is received on the hologram I (but not hologram II, etc.), in the first state of the luminaire 20 (see also FIG. 3). In FIG. 6C, the holographic optical element 25*b* has been moved laterally so that the beam spot is received on the hologram II (but not hologram I, etc.), in the second state of the luminaire 20 (see also FIG. 5).

The rectangular, circular and square shapes of the holographic optical element with two or more imprinted holograms are given by way of non-limiting examples. It will be appreciated that other layouts of the holographic optical element and/or shapes of the regions or imprinted holograms may be used. For example, holograms may be located at different angular locations on multiple rings or tracks on a circular substrate, e.g. in a manner analogous to locations of surface modulations representing bits or bytes on an audio compact disk or a video disk. Also, the integrated single 'element' example shown in FIGS. 3 to 6B is given by way of non-limiting example; and other implementations may provide the two or more holograms on two or more physical optical elements arranged or moved so as to selectively expose the different holograms to light from the laser light source.

In the examples of FIGS. 3 and 5 with a movable mountings for the holographic optical element 25 (and in other examples with similar movable mountings), the mounting 27 may move the element 25 in response to a manual activation, e.g. to enable a user to push the element 25*a* from side to side between the two states or to enable a user to rotate the circular optical element 25*b* among its various states. Alternatively, in other examples with movable mountings for the holographic optical element 25, the mounting 27 may be actuated by an automated mechanism represented by the motor 31. The motor 31, for example, might be an electrically controlled actuator of any type configured to move the element 25*a* from side to side between the two states in response to appropriate control signals applied to the motor. Alternatively, the motor 31 might be an electrically controlled actuator of any type configured to rotate the circular optical element 25*b* among its various states in response to appropriate control signals applied to the motor. In either case, the motor may step the holographic optical element between the illustrated states, or the motor may provide movement to and from intermediate state positions, e.g. in a somewhat more continuous manner.

The example luminaire 20 of FIGS. 3 and 5 also includes at least one substrate, for example, in the form of a plate 31. The phosphor(s) in this example act as photoluminescent material(s). The example shows phosphor regions on a single substrate or plate 31, although phosphor may be provided on multiple substrates at the appropriate locations. Also, this first example with a phosphor bearing substrate shows a flat phosphor plate 31 as the substrate, the substrate may have any curvature that may be desirable for a particular general illumination application; and several curved examples will be discussed later.

Although there may be a single phosphor region receiving light patterns in both states, the example luminaire 20 of FIGS. 3 and 5 has separate phosphor regions for the different beam distribution states provided by the different holograms. Hence, there are first and second phosphor regions 35*a*, 35*b* on the substrate 31, serving as photoluminescent materials in this example. The example shows multiple phosphor regions 35*a*, 35*b* on one substrate or plate 31, although phosphor may be provided on multiple substrates at the appropriate locations. The first and second phosphor regions 35*a*, 35*b* may be implemented as just two regions. In the illustrated example, however, the luminaire 20 has the phosphor region 35*a* separated into sub-regions "a" at appropriate locations on the substrate 31 to receive beams from the first pattern provided by hologram I in the first luminaire state, as shown in FIG. 3. Similarly, the luminaire 20 has the phosphor region 35*b* separated into sub-regions "b" at appropriate locations on the substrate 31 to receive beams from the first pattern provided by hologram II in the second luminaire state, as shown in FIG. 5.

The phosphors in the first and second phosphor regions 35*a*, 35*b* may be substantially the same, e.g. configured to provide white light of approximately the same color characteristics in both luminaire states. Alternatively, the phosphors in the first and second phosphor regions 35*a*, 35*b* may be different from each other, e.g. as appropriate to selectively provide white light that differs in one or more color characteristics in the two different luminaire states.

Optionally (or instead of the substrate and phosphors), the example luminaire 20 of FIGS. 3 and 5 may include a 'secondary' (2nd) optical system 37 coupled to the first and second regions of photoluminescent material, i.e. to the phosphor regions 35*a*, 35*b* in the illustrated example. The illustrated example utilizes individual lenses, shown generally in the shape of parabolic total internal reflection (TIR) lenses. The "A" lenses of a first optic 39*a* are coupled to the sub-regions "a" of first phosphor region 35*a*, and the "B" lenses of a second optic 39*b* are coupled to the sub-regions "b" of second phosphor region 35*b*. The lenses forming the two optics 39*a*, 39*b* of the optical system 37 may be substantially similar (as shown for convenience). Alternatively, the first and second optics 39*a*, 39*b* may provide different light output distributions and/or other differences in optical performance (e.g. different polarizations, differences in color filtering, or the like).

An optical support structure 41 holds the example lenses of the first and second optics 39*a*, 39*b* in place, in an assembly together with the regions 39*a*, 39*b* of photoluminescent material on the substrate 31, to provide suitable optical coupling of converted light from the phosphors and blue light if any from the patterns that may pass through the phosphors to the lenses of the first and second optics 39*a*, 39*b*. The structure of the optic support 41 will depend on the particular structure of the lenses or the like that form the optical system 37 and/or structure(s) of the substrate and photoluminescent regions.

As noted, the example optical system utilizes parabolic TIR lenses. It will be appreciated that, if provided, a secondary optical system 37 may use any of a wide range of other types of lenses or other optical devices (e.g. electrowetting optics, liquid crystal optics) in place of one or more of the TIR lenses in either optic 39*a* or 39*b*, and/or as replacements for all of the TIR lenses in either one or both of the optics 39*a*, 39*b*. Also, more unified optical systems/elements may be utilized, such as a single lens, prism or mirror, or a single transparent sheet of substantially uniform thickness or variable thickness in appropriate areas of the sheet. In another approach discussed later, the optical system comprises a passive lens formed of a solid transparent material. The passive lens includes a compound input surface having different surface portions optically coupled to the first and second phosphor regions; and the passive lens further includes a compound output surface.

Although different white light is given above by way of an example, different phosphors in the different regions 35*a*, 35*b* or even in different sub-regions "a" or different sub-regions "b" may convert the blue or ultraviolet light from the different beam patterns from the selected holograms I, II to various different somewhat more saturated visible or infrared colors, for example, to produce red (R), amber (A) green (G), yellow (B), etc. at different locations and/or during different luminaire states as desired for a particular tunable illumination application.

The mix of different colors to produce an overall output depends on the differences in the phosphors excited in the different luminaire states and any differences in intensity of light exposing the phosphors in different regions or sub-regions. In the example of FIG. 3, different intensities produced by different split-off beams in different patterns may also be used to adjust the relative contributions of different colors from different phosphors in one or more of the states of the luminaire. As another example, the states of FIGS. 3 and 5 could be configured so that the same sub-regions are exposed in both states; but in the first state (similar to FIG. 3) the split beams would vary in intensity, whereas in the second state (similar to FIG. 5) the split beams would all have approximately the same intensity. The pumped phosphor emissions from the different sub-regions would vary (first state) or be relatively uniform (second state), and therefore provide somewhat different states of pumped phosphor outputs for contribution to overall combined light output from the luminaire having a difference color characteristic in the different luminaire states.

The different lenses A, B in the two selective optics 39*a*, 39*b* may be configured to distribute light in any number of different ways, such as: different directions of light output (e.g. straight down in one state and to the left or right in another other state in the example orientation); different angular distribution ranges (e.g. one narrow spot light and one broader downlight in the example orientation): or different shapes of the overall luminaire output (e.g. one round and one oval or elliptical). The element(s) forming each of the two selective optics 39*a*, 39*b* may also provide some other selective optical processing, such as different polarizations, different output shapes, or different color filtering to match and enhance differences in color of light from the different phosphor regions 35*a*, 35*b*.

The laser diode(s) 23 of the light source and the holographic optical element 25 may be integrated in a unified module or contained together in a housing, as generally represented by the dotted line box 43 encompassing the laser diode 23 and holographic optical element 25. Some portion of the selector, such as the movable mounting 27 (or a controllable beam steering device in a later example) may be included within the module or housing 43. In the module or housing 43, the only optical path for light to exit may be through the holographic optical element 25, for example, to prevent emission of the laser beam without dispersal by a hologram on the holographic optical element 25. The holographic optical element 25 distributes the laser radiance to a wider distribution with a radiance level output from the holographic optical element 25 that may be about the same as the radiance level output by a light emitting diode (LED). For safety, the module or housing 43 may be frangible in some way so that substantial deformation or breakage of the module or housing 43 interrupts supply of current to the laser diode 23. In this way, the laser source is rendered inoperative if the module or housing is damaged in a way that might otherwise allow emission of light via another path or if the holographic optical element 25 is removed.

It may be helpful to consider a possible configuration for an example of a luminaire suitable for a particular general illumination application. This example uses blue laser light. Currently available GaN-based blue laser diodes provide 50 lm/W via blue-pumped phosphors. For a two-inch downlight application, a luminaire should produce about 500 lumens (lm) of white light output. The laser based luminaire therefore can have a small number of laser diodes to produce such output level, which draw a minimum of 10 W of electrical power.

In the design example, each hologram might distribute the light from the two blue laser diodes to fifty-two light phosphor spots, e.g. distributed in regions for exposure in different luminaire states as located in three, four or more concentric rings on a circular phosphor plate in several of the examples in the later drawings. On average, from the distributed blue pumping light, each phosphor spot would produce a luminous flux of 10 lm, for a total light output from the phosphors of 520 lm.

A suitable phosphor, for example, might be a metal-halide perovskite type quantum dot (QD) phosphor of an appropriate mixture to produce white light of a selected color temperature in response to blue light. Other photoluminescent materials may be used.

The phosphor spots may be smaller in size but there may be a larger number of spots. Such an approach may allow use of smaller (lighter and/or cheaper) optics coupled to the spots. Another approach might distribute the phosphor uniformly across a plate 31 or a non-flat substrate.

With the example tunable laser based downlight, there may be only two controlled emitters, i.e. the two laser diodes. In such a two diode implementation, selection would be implemented by one of the techniques described herein that does not require selective operation of multiple lasers. The printed circuit board for the light source of such a luminaire only needs to be large enough to mount and provide connections to the two laser diodes and to aim the laser beams at the appropriate spot on the holographic optical element. Also, the power supply circuitry only needs to control the two laser diodes. As laser diodes continue to improve, it may be possible in the near future to implement the example downlight with single blue laser diode.

A hologram, as used in the examples, may provide beam splitting via holographic diffraction of a coherent source, in the example, by diffraction of a laser beam from a laser light source. Each hologram is essentially a diffraction grating tailored to process light in a particular wavelength range. The irradiance of diffracted light on the photoluminescent material can be controlled by level of constructive interference provided by the particular design of the respective hologram grating. One holographic grating pattern determines one diffraction pattern for one intended split-beam light distribution.

For a general illumination application, the distribution of light from each hologram may be configured to provide a two dimensional or three dimensional distribution suited to a particular configuration of the photoluminescent material and/or to the optical system at the output of the luminaire. In some simple cases, even a one dimensional distribution may suffice.

As noted earlier, various hologram design techniques may be used. For purposes of discussion of an example of computer generation of a hologram for a luminaire, we will consider the one dimensional case; but it should be appreciated that the technology is readily adaptable to producing holograms for desired two dimensional and three dimensional distributions. For the simple one dimensional hologram, aspects of the hologram that may be adjusted in the design process to provide an intended distribution include grating material, spacing, height, shape, etc.

For any application, including for an illumination application, a light distribution is selected that is suitable for the application. For example, in a luminaire, a phosphor plate and/or optical system may be designed for the application; and a distribution may be determined to provide beams of light to selected locations on the phosphor substrate. The manufacturer of the holographic optical element runs a computer simulation program to determine the grating material, spacing, height, shape, etc. that will provide the diffractive beam splitting of the particular laser wavelengths so as to produce the specified light distribution from the hologram. The grating designed via the computer program is then imprinted on the substrate material of holographic element.

As noted, this approach to computer aided design can be expanded to provide two dimensional or even three dimensional light distribution from the hologram, and the light distribution generated by the holographic optical element will exhibit relatively high optical efficiency. A coherent light source, such as a laser light source, is highly effective for distribution of light via a holographic optical element, since little or no dispersion happens (no other colors and same incident direction) between the source and the holographic optical element.

The photoluminescent material may be provided on a light transmissive plastic substrate, similar to a sheet material utilized for a light guide. The plastic sheet substrate may be coated with a uniform phosphor or coated with phosphors at appropriate sub-regions. The substrate may be flat or contoured (e.g. curved) in one, two or three dimensions. Patterned phosphor on the plate or other substrate may enable either a color-tunable function or a light shaping function via the optical system or both tunable functions in combination. An example of a suitable photoluminescent material is metal-halide perovskite QD phosphor. Such a phosphor may be sprayed via a nozzle on a relatively large panel of a luminaire. The panel can be masked for several phosphor regions. The particular type of phosphors in the example may be pumped by UV or blue light.

For different color characteristics, the mixture of such phosphors in the photoluminescent material is somewhat different. With the metal-halide perovskite QD phosphor, however, the different regions of different mixtures for warm white phosphor and cool white phosphor do not exhibit perceptible differences in appearance when not actively pumped by a light distribution. As a result, a patterned phosphor plate configuration may still give a relatively uniform appearance across the panel when the luminaire is not in use.

Because the holographic optical element distributes the light to the photoluminescent material, the light intensity and heat at any particular location on the substrate is much lower than the power of the laser beam. The lower light intensity and heat allows use of a wider variety of photoluminescent materials including some that may not be suitable to direct irradiance by a laser beam of the power levels discussed here for illumination applications.

Although shown as individual lenses, because of the small spot sizes from the split beams and the corresponding phosphor sub-regions, the optical system may be implemented as an optical film with features of the film suitably sized and shaped to perform the functions of the lenses shown by way of examples in the drawings.

Figure 7:
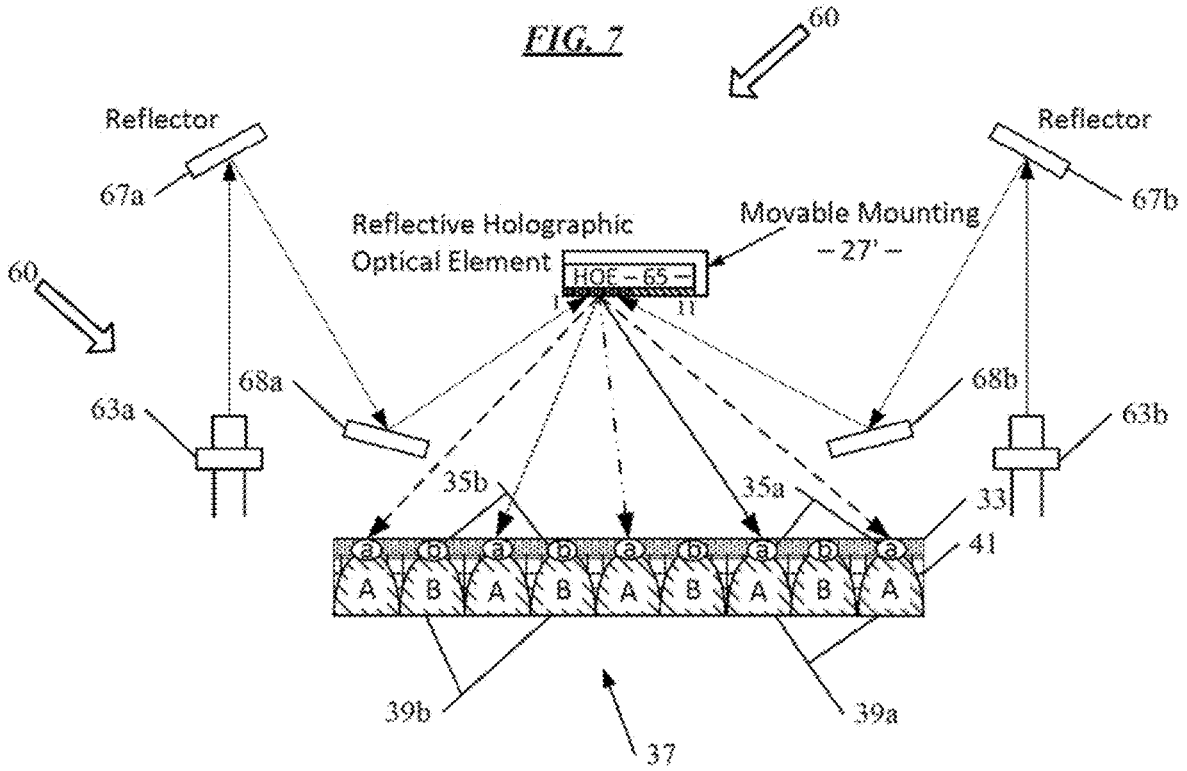
FIGS. 7 and 8 are side/partial cross-sectional views of a further example tunable laser-based luminaire that utilizes multiple laser diodes, mirrors and a movable reflective holographic optical element, in first and second luminaire states respectively.
Figure 8:
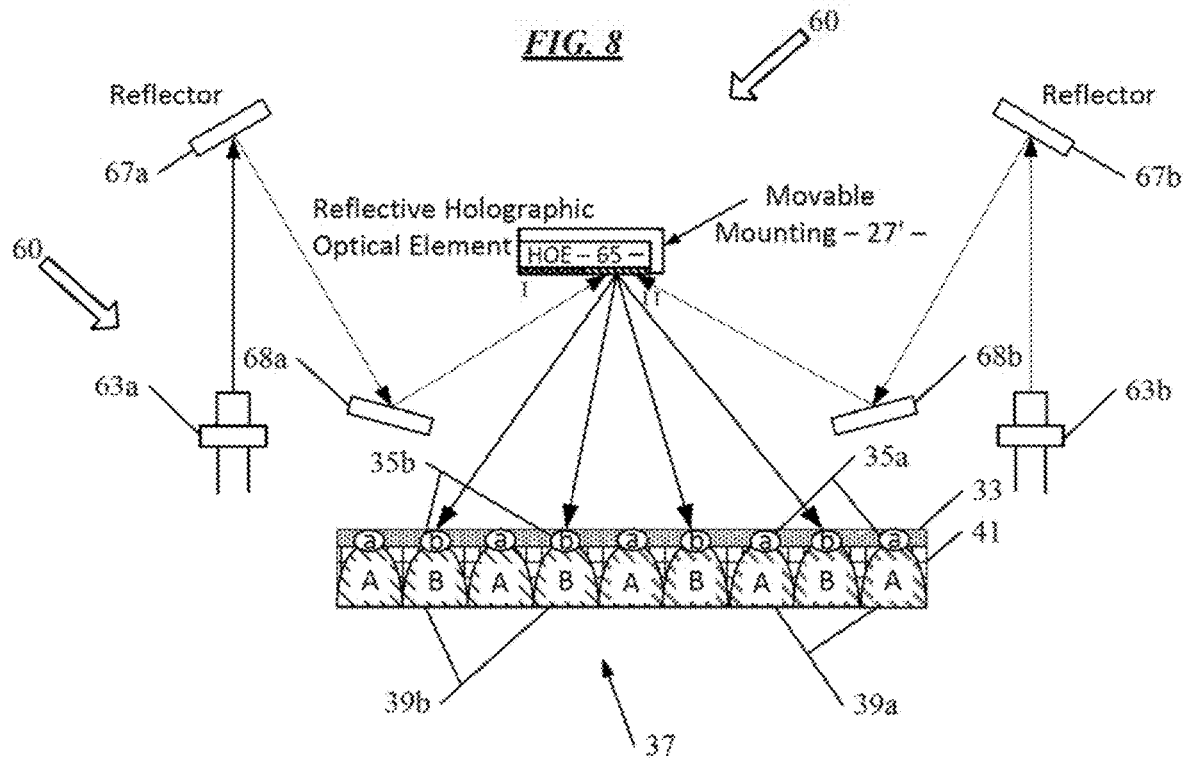
Figure 9:
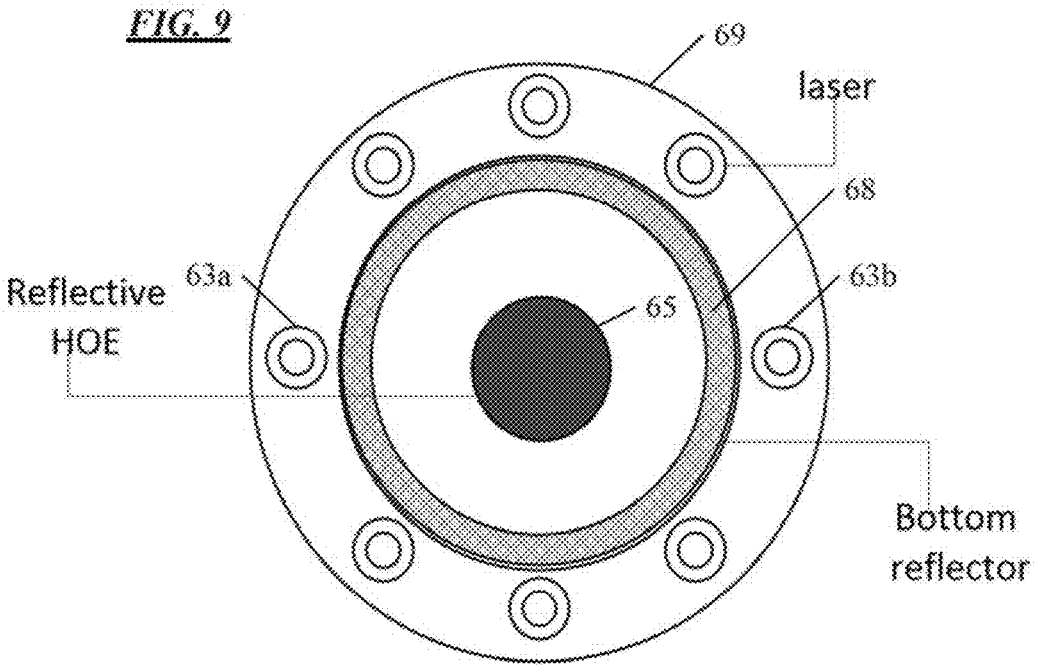
FIG. 9 is a plan view of several components as might be used in a luminaire similar to the example luminaire of FIGS. 7 and 8.

FIGS. 7 and 8 are side/partial cross-sectional views of a further example 60 of a tunable laser-based luminaire. The luminaire 60, in this example, utilizes a reflective holographic optical element and has two or more laser diodes as the laser light source. FIGS. 7 and 8 show the luminaire 60 in two different states, and FIG. 9 is a plan view of some of the components of the luminaire 60. The luminaire 60 includes at least two laser diodes 63*a*, 63*b* and may include one or more additional laser diodes. The plan view of FIG. 8 shows eight laser diodes by way of a non-limiting example, includes the laser diodes 63*a*, 63*b*.

The luminaire 60 includes holographic optical element 65, which in this example, is a reflective holographic optical element. The holographic optical element 65 has a first hologram I and a second hologram II imprinted on a reflective surface of the element 65 to disperse the light from the lasers in two different patterns. As mentioned earlier, there may be additional holograms providing additional light distribution patterns. The properties of the holograms are similar to those of holograms discussed with regard to the earlier examples. The use of a reflective holographic optical element 65 may be beneficial in that some available reflective holographic optical elements can endure exposure to higher laser irradiance with little or no degradation or damage, in comparison to currently available transmissive holographic optical elements.

The example luminaire 60 implements a mechanical position selector approach via selective movement of a movable mounting 27' for the holographic optical element 65. The movable mounting 27' is similar to the mounting 27 in the luminaire 20 (FIGS. 3 and 5) except that the mounting 27' supports the element 65 in an orientation appropriate for reflection of light from the laser light source rather than transmission of light from the laser light source as in the earlier example. As in the earlier example, however, the mounting 27' and the holographic optical element 65 may be moved manually or automatically, e.g. by a motor or the like not shown for convenience in FIGS. 7 and 8. Of course, other arrangements for selecting which hologram is exposed to a laser beam in each luminaire state may be used in a luminaire with a reflective holographic optical element and multiple laser diodes.

The structure of the holographic optical element 65 and the number and arrangement of the holograms on the element 65 are similar to those discussed above relative to FIGS. 3 to 6C, except for the reflective aspect of the holographic optical element 65. For purposes of further discussion of the example luminaire 60, however, it is assumed that the movable mounting 27' provides selective mechanical motion of the holographic optical element 65 between the two luminaire states, exposing the two holograms I, II. In that luminaire configuration, the beams from the laser diodes are directed to approximately the same exposure location within the luminaire 60 in both luminaire states, to selectively expose the two holograms I, II to laser light when the holographic optical element 65 is in the two different positions shown in FIGS. 7 and 8.

The laser diodes 63*a*, 63*b* may be aimed to directly emit laser beams toward the reflective surface of the holographic optical element 65, similar to the aiming of the lasers in the luminaire examples of FIGS. 3 and 5. In the example of FIGS. 7 and 8, however, the luminaire 60 includes one or more mirrors to reflect the laser beams to the appropriate location to expose a selected one of the holograms I, II on the holographic optical element 65. There may be one mirror reflection, two mirror reflections or more mirror reflections in the path between each laser diode and the holographic optical element 65, depending on design parameters of the particular luminaire configuration (e.g. size and shape of the luminaire and/or number of laser diodes chosen to provide the appropriate output intensity for a particular illumination application). The example in these drawings includes two mirror reflections in the path between each laser diode and the holographic optical element 65.

For ease of illustration, the views in FIGS. 7 and 8 show two individual mirrors in each beam path. The laser diode 63*a* emits its beam toward mirror 67*a*, the mirror 67*a* reflects that beam to the mirror 68*a*, and the mirror 68*a* reflects the beam to the holographic optical element 65. Similarly, the laser diode 63*b* emits its beam toward mirror 67*b*, the mirror 67*b* reflects that beam to the mirror 68*b*, and the mirror 68*b* reflects the beam to the holographic optical element 65.

These mirrors may be individual components or may be formed in other ways. In a circular arrangement, for example, the mirrors 67*a*, 67*b* may be respective areas of a ring-shaped mirror. Similarly, the mirrors 68*a*, 68*b* may be respective areas of another ring-shaped mirror, such as the mirror 68 shown (as if in front of the plate 69) in the view of FIG. 9 looking toward the holographic optical element. For optical efficiency, the mirrors may be highly reflective with little or no dispersion of the reflected light (e.g. substantially specular), at least for light of the wavelengths emitted by the particular type of laser diodes.

The laser diodes may be supported in any suitable manner. In the example of FIG. 9, the laser diodes are supported at equally spaced locations around a ring-shaped plate 69 formed of a suitably heat resistant material (e.g. aluminum, etc.). In the plan view, the reflective surface of the holographic optical element 65 is visible through the central opening through the support plate 69. The plate or other structure(s) to support the laser diodes and the various mirrors is/are omitted from FIGS. 7 and 8 for convenience.

Although other arrangements of photoluminescent material(s) and/or secondary optics may be utilized in various implementations of a luminaire like luminaire 60, the illustrated example (FIGS. 7 and 8) includes an arrangement similar to that used in the luminaire example FIGS. 3 and 5; and the same reference numbers are used to identify the elements of luminaire 60 that are structured and function in essentially the same ways as the similarly numbered elements of luminaire 20.

Hence, the luminaire 60 includes at least one phosphor bearing substrate 33, and the phosphor(s) in regions 35*a*, 35*b* that act as photoluminescent material(s) in this example are separated into relatively small sub-regions a, b at appropriate locations on the substrate 33 to receive the split beams from the patterns provided by the different holograms I, II on holographic optical element 25 in the two illustrated luminaire states shown in FIGS. 7 and 8.

Optionally, the example luminaire 60 of FIGS. 7 and 8 may include a 'secondary' (2nd) optical system 37 coupled to the photoluminescent material, i.e. to the phosphor(s) in regions 35*a*, 35*b* as in the earlier example. Although other optics may be used as outlined above, the illustrated example utilizes individual lenses 39*a*, 39*b*, as in the earlier example of FIGS. 3 and 5. An optical support structure 41 holds the example lenses 39*a*, 39*b* of the optical system 37 in place, in an assembly together with the sub-regions of phosphor type photoluminescent material in regions 35*a*, 35*b* on the substrate 33, to provide suitable optical coupling of converted light from the phosphor(s) and blue light if any from the patterns that may pass through the phosphor(s) to the lenses 39*a*, 39*b*.

Other aspects and/or alternative implementations of the arrangement of the substrate, the photoluminescent material, the lenses or other optics and the support structure should be readily apparent from the discussion of FIGS. 3 and 5 above and/or other later luminaire examples.

As noted earlier, a holographic optical element carrying multiple holograms may be a relatively small, light-weight component, for example, may having of 1 $cm^2$ or less. For luminaires like the examples of FIGS. 3 to 9 in which the transmissive or reflective holographic optical element is moved to select among the different holograms, the linear or rotational distance to move a multi-hologram type element to expose one hologram instead of another hologram on the element is small, e.g. around 1 mm. Hence, the mechanism to move such a multi-hologram type holographic optical element (e.g. the movable mounting and the associated motor, in the illustrated examples) can be relatively small, simple and lightweight.

Although the movable support in examples such as those in FIGS. 3 to 9 enable movement of the holographic optical element, an alternative approach would enable movement of the laser light source relative to the holographic element. Such an alternate approach to changing which hologram is exposed in the different luminaire states might aim the beam(s) from the laser light source to the first hologram in the first luminaire state, and then move the laser light source to aim the beam to the second hologram in the second luminaire state. The laser source movement/mounting/motor could be similar to those of the holographic optical element in the in examples of FIGS. 3 to 9, e.g. side-to-side movement, movement in a circle about an axis, or two-dimensional lateral/longitudinal motion. By way of another alternative example, the movement of the laser light source might be angular, to change the angular direction of beam output by the source.

Figure 10:
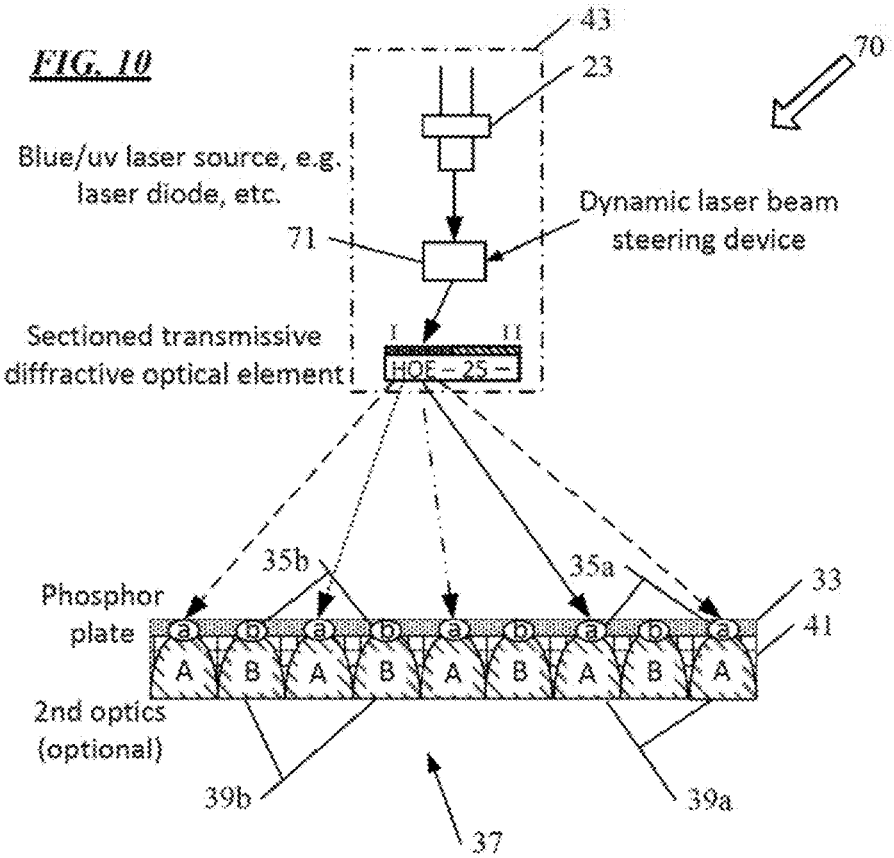
FIGS. 10 and 11 are side/partial cross-sectional views of a further example tunable laser-based luminaire, using a variable beam steering optic to selectively steer the beam of light from the laser light source to the different holograms, in first and second luminaire states respectively.
Figure 11:
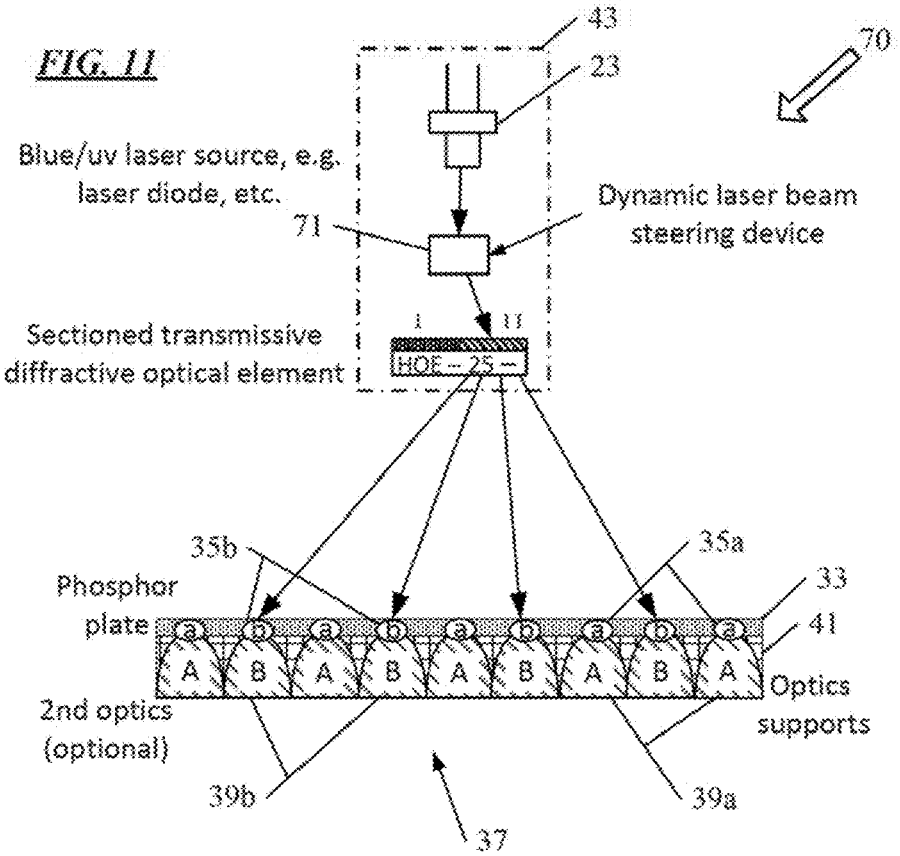

A further class of technologies for the selection among the holograms utilizes beam steering. Laser beam steering is a relatively mature, reliable technology. FIGS. 10 and 11 are side/partial cross-sectional views of an example tunable laser-based luminaire 70, using a variable beam steering optic to selectively steer the beam of light from the laser diode 23 of the laser light source to the different holograms, in the first and second states respectively.

The light source using a laser diode 23 is the same as in several of the earlier examples. As in other examples, only one diode 23 is shown for convenience, however, the laser light source in the luminaire 70 may include one or more additional laser diodes. Although the holographic optical element in a luminaire like 70 may be reflective, the illustrated example utilizes a transmissive holographic optical element 25. The holographic optical element 25 is the same as the element 25 in several of the earlier examples. In the luminaire 70, however, there is no movable mounting. Instead, the holographic optical element 25 is mounted at a fixed location relative to the laser diode 23, e.g. within the module or housing 43.

The luminaire 70 includes a dynamic laser beam steering optic 71. The drawings illustrate an example of optic 71 that is transmissive, such as a liquid-crystal polarization grating or an optical antenna/phased array. Although not shown, a dynamic laser beam steering optic may be reflective. Examples of reflective steering optics include galvo mirror scanners and digital mirror devices (e.g. a micro-electronic-mechanical system (MEMS), electrowetting optic, liquid crystal polarization grating (LCPG), or the like). A small angle shift can result in mm movement of the beam to a different hologram I or II if the distance between beam steering optic 71 and holographic optical element 25 is in the cm range.

In one state, a controller (e.g. as shown in FIG. 34) provides a control signal to the beam steering optic 71; and in response, the beam steering optic 71 enters a state so as to direct the laser beam from the laser diode 23 to the hologram I on the holographic optical element 25, as shown in FIG. 10. In a second state, the controller provides a different control signal to the beam steering optic 71; and in response, the beam steering optic 71 enters a state so as to direct the laser beam from the laser diode 23 to the other hologram II on the holographic optical element 25, as shown in FIG. 11. Depending on the implementation of the beam steering optic 71, there may be intermediate states, e.g. in which the optic directs the beam to overlap some of both holograms. Where the holographic optical element 25, carries one or more additional holograms, the beam steering optic 71 would be similarly controllable to direct the beam to any additional hologram(s) and possibly additional intermediate states to overlap the beam on the additional hologram(s).

Although other arrangements of photoluminescent material(s) and/or secondary optics may be utilized in various implementations of a luminaire like luminaire 70, the illustrated example (FIGS. 10 and 11) includes an arrangement similar to that used in the luminaire example FIGS. 3 and 5; and the same reference numbers are used to identify the elements of luminaire 70 that are structured and function in essentially the same ways as the similarly numbered elements of luminaire 20.

Hence, the luminaire 70 includes at least one phosphor bearing substrate 33, and the phosphor(s) in regions 35*a*, 35*b* that act as photoluminescent material(s) in this example are separated into relatively small sub-regions a, b at appropriate locations on the substrate 33 to receive the split beams from the patterns provided by the different holograms I, II on holographic optical element 25 in the two illustrated luminaire states shown in FIGS. 10 and 11.

Optionally, the example luminaire 70 of FIGS. 10 and 11 may include a 'secondary' (2nd) optical system 37 coupled to the photoluminescent material, i.e. to the phosphor(s) in regions 35*a*, 35*b* as in the earlier example. Although other optics may be used as outlined above, the illustrated example utilizes individual lenses 39*a*, 39*b*, as in the earlier example. An optical support structure 41 holds the example lenses 39*a*, 39*b* of the optical system 37 in place, in an assembly together with the sub-regions of phosphor type photoluminescent material in regions 35*a*, 35*b* on the substrate 33, to provide suitable optical coupling of converted light from the phosphor(s) and blue light if any from the patterns that may pass through the phosphor(s) to the lenses 39*a*, 39*b*.

Other aspects and/or alternative implementations of the arrangement of the substrate, the photoluminescent material, the lenses or other optics and the support structure should be readily apparent from the discussion of FIGS. 3 and 5 above and/or other later luminaire examples.

Figure 12:
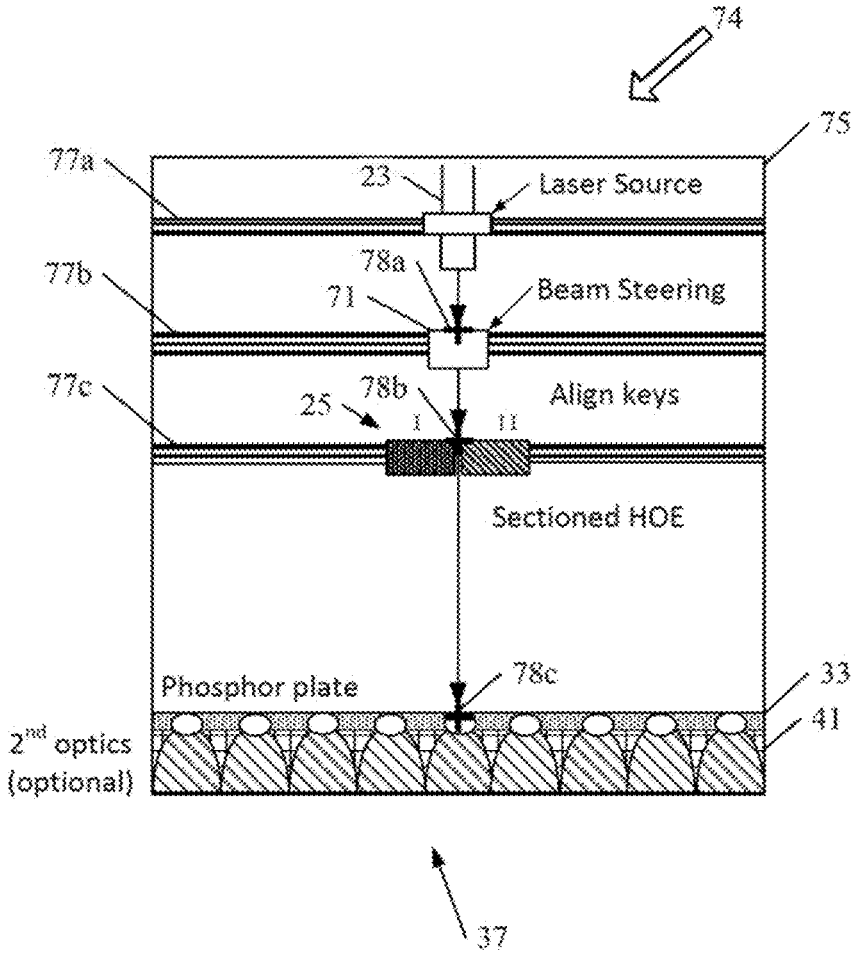
FIG. 12 is a cross-sectional view of a luminaire arrangement with a housing and chassis supports, useful in understanding several techniques to enhance safety of a laser-based luminaire and understanding a technique for aligning the elements of a tunable laser-based luminaire.

FIG. 12 is a cross-sectional view of a luminaire arrangement with a housing and chassis supports. The luminaire 74 includes, by way of example, elements 23, 25, 31, 37, 41 and 71 of the example luminaire shown in FIGS. 10 and 11. The example luminaire 74 is useful in understanding several techniques to enhance safety of a laser-based luminaire and understanding a technique for aligning the elements of a tunable laser-based luminaire, although the safety features and alignment technique may be readily adapted to any of the other tunable laser-based luminaire implementation disclosed herein or otherwise suggested by the present teachings.

Consider first the safety aspects.

The luminaire 74 includes an overall housing 75 that, together with the plate 33, fully encloses the laser light source (e.g. diode 23) and the internal optical system components (e.g. beam steering optic 71 and the holographic element 23). The plate 33 and the support 41 for the lenses or the like of the secondary optical system 37 are attached to the sidewall(s) of the housing. The housing 75 is sealed with respect to light emissions and the coupling of the housing 75 to the plate 33 permits light output only through the plate 33, the phosphors or other photoluminescent material(s) on the plate 33, and the secondary optical system 37, for example, to prevent leakage of the laser beam.

The luminaire 74 also includes several chassis elements 77*a* to 77*c*, attached to the interior of the housing 74, which support the internal elements 23, 25 and 71 of the luminaire 74. The chassis element 77*a* is configured to provide heat dissipation. For example, the chassis 77*a* may be configured as or coupled to a heat sink.

The holographic optical element 25 distributes the laser radiance to a wider distribution, and the radiance level output in any one direction from the holographic optical element 25 may be about the same as the radiance level output by a light emitting diode (LED). As a result, light from the holographic optical element 25 would have a similar intensity level and similar level of risk as the output of a LED used today in a typical LED based luminaire. At this point in the system, the light is no longer at the higher, potentially harmful level originally output from the laser diode 23 or the like. To insure this safety feature is effective, it may be helpful to configure the beam steering optic 71 (and/or the control thereof) so as to prohibit steering of the beam in a direction that does not impact the holographic optical element 25.

Also, the conversion by the phosphor or other photoluminescent material(s) on the plate 31 produces a wider range of wavelengths and scatters the resultant light including any blue or UV light. Hence, the conversion tends to reduce spectral energy density and to further reduce spatial energy density.

As an added layer of protection, it may be desirable to use a short-pulse laser operation, e.g. to mitigate any heat accumulation on an organism that might be impacted by the laser beam if other protection measures fail. The pulse duration would be short enough so that the average pulse exposure of human tissue (e.g. skin or eye) to the laser beam is low enough to minimize or prevent long term damage to such tissue. For example, if a human eye is exposed to the laser beam, the eye has some time to recover between pulses of the laser beam. An example ON time of a laser pulse may be around one nanosecond or a few nanoseconds. Also, if blue laser diodes are used, the strong laser light would be visible, and long term exposure could be avoided by a person in the vicinity before the accumulated dosage of too many pulses becomes dangerous.

Consider next the example alignment technique illustrated in FIG. 12.

During assembly, the manufacturer inserts a number of alignment keys 78*a* to 78*c* into the components within the luminaire 74. In the example, an alignment key 78*a* is inserted in the optical beam steering device 71, an alignment key 78*b* is inserted between the two holograms I and II on holographic optical element 25, and an alignment key 78*c* is inserted at a mid-point of the phosphor plate 33.

With the alignment keys in place, the laser light source (diode 23 in the example) is turned ON; but the selectable feature(s) is kept in the neutral state. In the example using beam steering, the steering device 71 directs the beam to a neutral position, e.g. at the intersection in between the two holograms I and II and through to the mid-point of the phosphor plate 33. The alignment keys 78*a* to 78*c* should be in the path of the laser beam if the elements are properly aligned. The keys 78*a* to 78*c* are transmissive, and if the beam is visible light, e.g. blue, then a technician should be able to see the beam passing through each key as an indication of proper alignment. If not aligned, adjustments may be made to the one or more of the chassis elements 77*a* to 77*c* to achieve alignment. Once aligned, the keys 78*a* to 78*c* may be removed.

Of course, more automated alignment techniques may be developed for mass production purposes.

Figure 13:
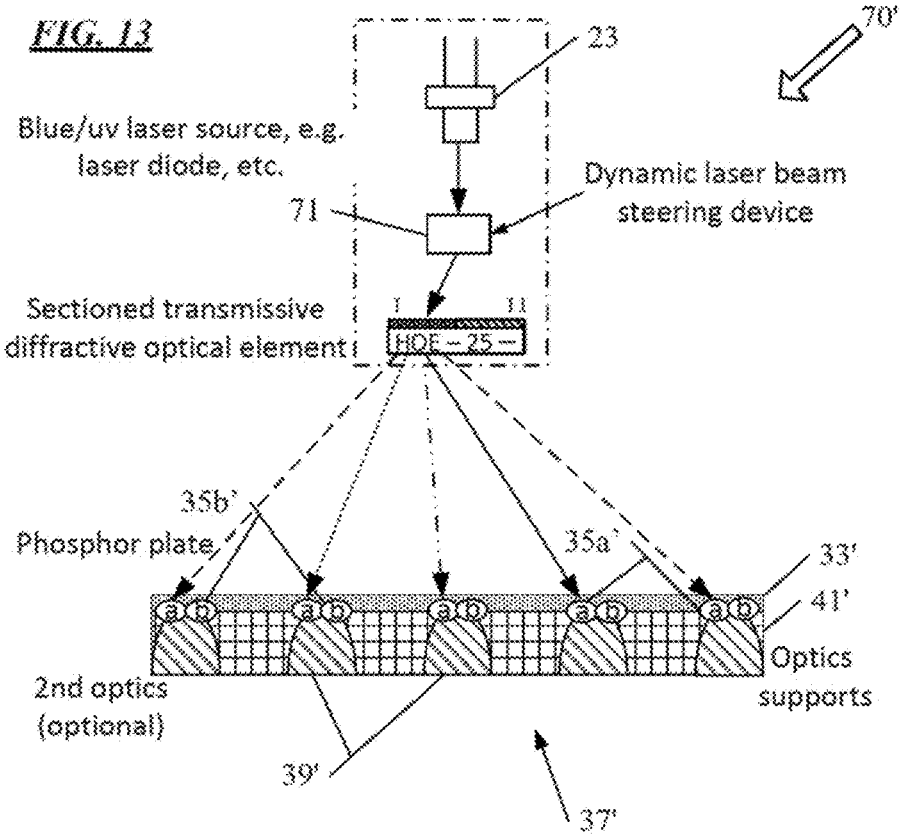
FIGS. 13 and 14 are side/partial cross-sectional views of another example tunable laser-based luminaire, using a variable beam steering optic to selectively steer the beam of light from the laser light source to the different holograms, in first and second luminaire states respectively.
Figure 14:
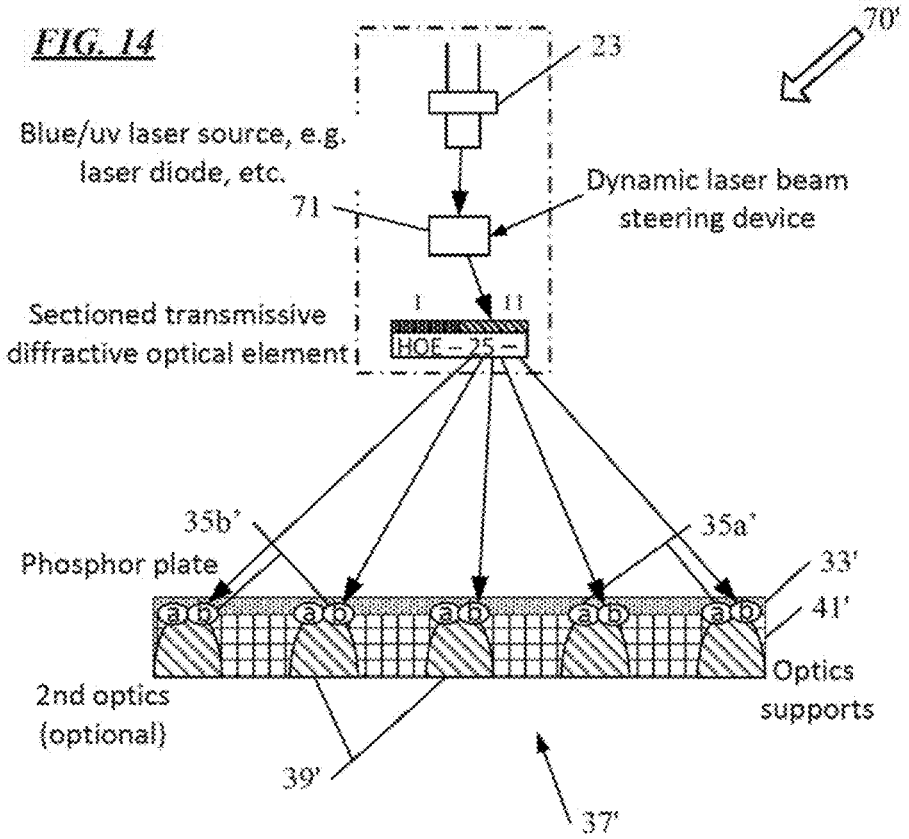

FIGS. 13 and 14 illustrate a luminaire 70' similar to the luminaire 70 of FIGS. 10 and 11, and the illustrations of luminaire 70' utilize the reference numbers for elements that are structurally and/or functionally the same as in the luminaire 70. The regions of photoluminescent material and the optics of the optical system, however, are implemented in a manner different from in the luminaire 70.

In the example luminaire 70', the example optical system 37' includes a single set of optics 39' coupled to process light in both states of the luminaire, held in appropriate locations by optics support structure 41'. Otherwise, the optics of the system 37' may be generally similar to elements of other optical systems in any of the other examples.

The sub-regions 35*a*', 35*b*' of photoluminescent material may be phosphors or other materials of different types a and b as discussed earlier. In the luminaire 70', however, there are two sub-regions 35*a*', 35*b*' associated with each optic 39'. The sub-regions 35*a*', 35*b*' may be phosphors supported on at plate 33'. Alternatively, the sub-regions 35*a*', 35*b*' may be phosphors supported on input surfaces of the optics 39', which may eliminate the need for the plate 33'.

FIG. 13 illustrates a first luminaire state in which the beam steering optic 71 directs the beam from the light emitting diode(s) 23 to the first hologram I on holographic element 25, and the diffractive hologram I splits that beam into a first projection pattern of lower intensity beams. In that first luminaire state, the distribution from first hologram I provides blue or UV light to the sub-regions 35*a*', which produce light of a first color characteristic for output from the luminaire 70' via the optics 39'. FIG. 14 illustrates a second luminaire state in which the beam steering optic 71 directs the beam from the light emitting diode(s) 23 to the second hologram II on holographic element 25, and the diffractive hologram II splits that beam into a second projection pattern of lower intensity beams. In that second luminaire state, the distribution from second hologram II provides blue or UV light to the sub-regions 35*b*', which produce light of a different second color characteristic for output from the luminaire 70' via the optics 39'.

Although the color characteristics differ in the two states in the example luminaire 70', due to the excitations of different phosphors a and b, the shape and direction of the luminaire output distribution from optics 39' of system 37' will be approximately the same in both states. The output light intensity in different regions across the luminaire output distribution may be the same in both states; or the output light intensity in different regions across the luminaire output distribution may vary between the two states, if the two holograms provide different intensity distributions to the different phosphor regions 35*a* and 35*b*.

The arrangement of the phosphor regions and optics shown in FIGS. 13 and 14 may be used in any of the other luminaire examples disclosed herein, for example, in luminaires utilizing reflective holographic elements and/or in luminaires utilizing any of the other example hologram selection techniques.

Figure 17:
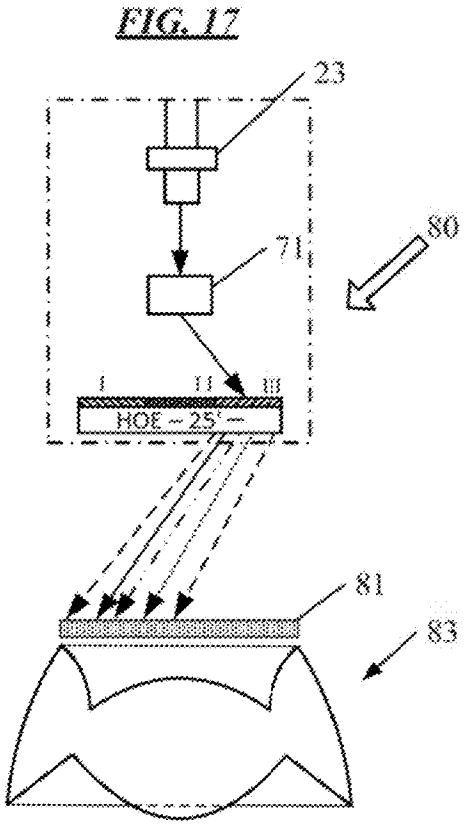
FIGS. 15 to 17 are side/partial cross-sectional views of a further example tunable laser-based luminaire, using a variable beam steering optic to direct the beam as well as a complex passive lens to provide different output distributions, in three different luminaire states.
Figure 16:
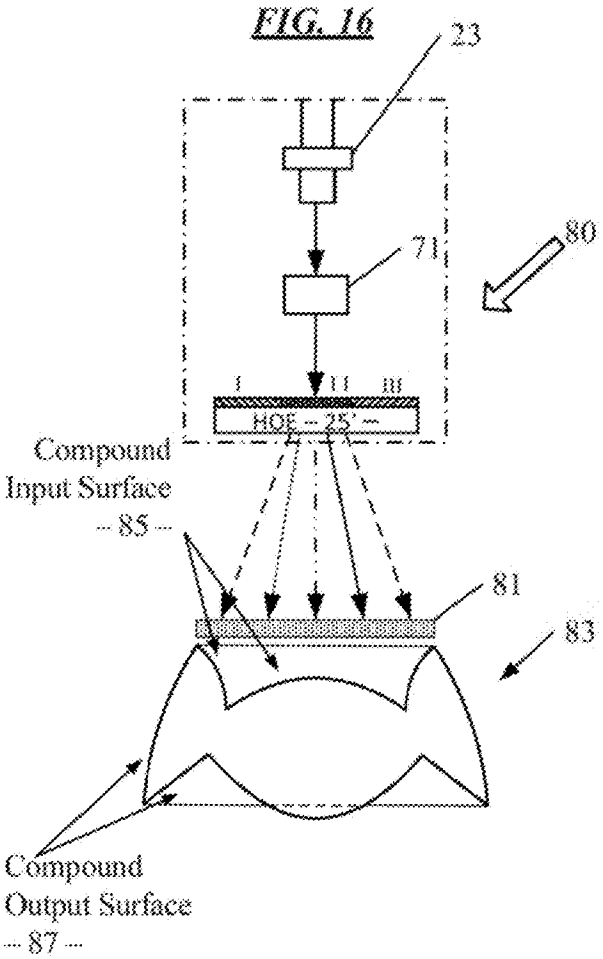
Figure 15:
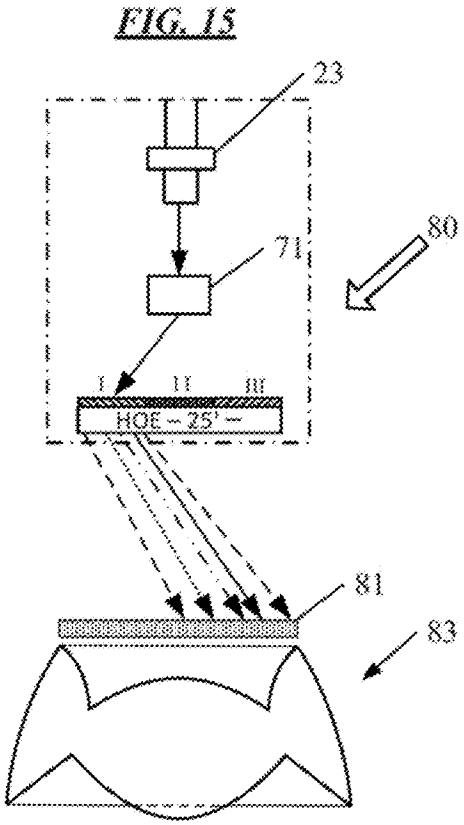

FIGS. 15 to 17 show different states of another example luminaire 80 having a laser light source in the form of one or more laser diodes 23 and a holographic optical element 25'. The element 25' may have first and second holograms, as in earlier examples. In the example luminaire 80, the element 25' has three different holograms I to III. As in other examples, the holograms are configured to distribute a beam of light from the diode 23 of the example laser light source into different patterns of light, for example, to diffractively split the initial laser beam into a distribution of lower power beams of UV or blue light.

The laser light source (e.g. diode 23) and the holographic optical element 25' are configured relative to each other so that the beam of light from the laser light source can be selectively directed to the various holograms I to III, in this example, in a first, second and third states of the luminaire 80. Although the luminaire 80 may utilize other disclosed techniques for directing the laser beam to the different holograms I to III, for convenience, the example luminaire 80 utilizes a beam steering device 71 as in the earlier example luminaires shown in FIGS. 10 to 14.

The example luminaire 80 of FIGS. 15 to 17 includes photoluminescent material shown in the form of a plate 81 bearing a continuous phosphor region. Such an arrangement would utilize the same mixture of phosphors across the lateral extent of the plate 81. Arrangements of photoluminescent material similar to those in other disclosure examples instead may be utilized in the example luminaire 80.

The example luminaire 80 also includes a passive compound-surface lens 83 formed of a solid transparent material. The passive lens 83 includes a compound input surface 85 having different surface portions optically coupled to receive light based on the first pattern of light from the first of the holograms I in the first state of the luminaire 80 (FIG. 15), to receive light based on the second pattern of light from the second of the holograms II in the second state of the luminaire 80 (FIG. 16), and to receive light based on the third pattern of light from the third of the holograms III in the third state of the luminaire 80 (FIG. 17). The passive lens 83 also has a compound output surface 87 having different surface portions to output light with a first, second and third distributions in the three states of the luminaire 80.

In the example luminaire 80, the passive lens 83 is a circular compound-surface lens shown in cross-section without hatching, e.g. if the lens 83 viewed from a perspective along the optical axis of the luminaire 80 (looking toward the lens 83 from above or below in the illustrated orientation). The circular compound-surface lens is made of suitably shaped solid transparent material having aspheric or spheric surfaces. The circular lens is suitable, for example, spotlight or square downlight applications. A rectilinear passive lens with a similar cross section and made of the same or similar material may be utilized for elongated, substantially rectangular (non-square) illumination applications, such as a selective wall washing or grazing application along a horizontally extended section of a wall. Such a rectilinear compound-surface lens may have surfaces that correspond to sections of one or more cylinders or the like (where the circular example has aspheric or spheric surfaces). For convenience, further discussion of the compound-surface lens implementation of passive lens 83 will concentrate on the circular example of the compound-surface lens implementation.

The compound-surface lens implementation of passive lens 83 is positioned over or across the path of light outputs distributed from the holograms I to III of the holographic optical element 25'. The aspheric or spheric surfaces of the compound-surface lens passive lens 83 include, for example, the compound input surface 85 facing in a direction to receive light from the holographic optical element 25' and the compound output surface 87. In a circular implementation of the compound-surface lens implementation of passive lens 83, the compound input and output surfaces are centered along the optical axis of the luminaire 80 (as may correspond to the neutral/center path of the beam from diode 23).

The compound input surface 85 of the compound-surface lens 83, facing the holographic optical element 25', includes an input peripheral portion and an input central portion, both of which are somewhat convex in the illustrated example. The input peripheral portion extends from relative proximity to the holographic optical element 25' toward an interface or edge formed at a junction with the input central portion; and the input peripheral portion has an angled convex curvature. The input central portion curves towards the holographic optical element 25', e.g. with a convex curvature across the optical axis and facing directly toward the holographic optical element 25' in the illustrated example orientation. The convex central portion of the compound input surface 85 is spheric in the example, e.g. corresponds in shape to a portion of a sphere.

The compound output surface 87 (opposite the input surface 85 and the holographic optical element 25') includes an output lateral portion, an output shoulder portion, and an output body portion. The output lateral portion forms the outer peripheral surface of the passive lens 83. The output lateral portion is considered part of the compound output surface 87 in that some light may emerge via at least part of that peripheral surface in one or more of the luminaire states, although that surface may provide total internal reflection (TIR) for other light and/or in a different luminaire state, depending on the angle of diffracted light rays from split beams from the holographic optical element 25' in the various luminaire states.

The output lateral portion extends away from relative proximity to the holographic optical element 25', where it forms an interface or edge at the junction with the peripheral portion of the compound input surface 85. The output lateral portion curves away from the interface or edge formed at the junction with the input peripheral portion of the lens input surface 85, and intersects the output shoulder portion at a distal edge or interface away from the holographic optical element 25'. The output shoulder portion of the output surface 87 extends inward from the output lateral portion of the compound output surface to where the shoulder portion abuts the output body portion of the compound output surface 87. The output body portion curves outwards (convex) away from the holographic optical element 25', e.g. with a convex curvature across the optical axis and away from the edge formed at the abutment with the output shoulder portion. The convex output body portion of the compound output surface 87 is spheric in the example, e.g. corresponds in shape to a portion of a sphere.

Incoming light rays from a hologram of the holographic optical element 25', can first pass through the compound input surface 85 where the incoming light rays undergo refraction to shape or steer the illumination lighting. After passing through the compound input surface 85, the refracted incoming light rays can then pass through the portions of the compound output surface 87 where the refracted incoming light rays undergo further refraction to shape or steer the illumination lighting.

Alternatively or additionally, after passing through the compound input surface 85, the refracted incoming light rays can then strike the output lateral portion of the compound output surface 87 (i.e. the peripheral wall/surface of the passive lens 83) where the incoming light rays undergo total internal reflection (TIR) to further shape or steer the illumination lighting. After TIR at the output lateral portion, the light rays can pass through the output shoulder portion with further refraction.

With a compound-surface lens such as example passive lens 83, different light distributions by the holograms I to III of the holographic optical element 25' result in different refraction and thus different directions of light output in the three different states of the luminaire 80. Additional information about lenses like the example lens 83 of FIGS. 15 to 17 may be found in Applicant's: U.S. patent application Ser. No. 15/868,624, filed Jan. 11, 2018; U.S. patent application Ser. No. 15/914,619, filed Mar. 7, 2018; and U.S. patent application Ser. No. 15/924,868, filed Mar. 19, 2018, the complete disclosures of all three of which are incorporated entirely herein by reference. The shape of passive lens 83 and the description above are given by way of non-limiting examples, and other compound-surface lenses may be utilized.

The drawings show the photoluminescent material at plate 81 located for optical coupling of pumped emissions to the compound input surface 85 of the passive lens 83. The photoluminescent material, however, may be located to receive distributed blue or UV light from the compound output surface 87 of the passive lens 83.

The arrangement of the photoluminescent material and/or the passive lens shown in FIGS. 15 to 17 may be used in any of the other luminaire examples disclosed herein, for example, in luminaires utilizing reflective holographic elements and/or in luminaires utilizing any of the other example hologram selection techniques. The passive lens 83 also may be utilized with other arrangements of photoluminescent material as described relative to other luminaire examples.

Another class of technologies for the selection among the holograms utilizes gated or switchable holographic optical elements. A holographic element of this type is capable of switching between at least two states, e.g. between a transparent non-holographic state and a transmissive or reflective holographic state. An example of a gated or switchable holographic element is a Holographically Formed, Polymer Dispersed Liquid Crystals or HPDLC device. During manufacture, the liquid crystal (LC) material is developed so that in one selectable state it acts as a hologram. In another selectable state, the LC material performs a different optical processing, such as reflection or transparent transmission. The hologram formed in the LC material may be designed to function as any of a variety of different types of optical processing element, including for purposes of the discussion here, as a reflective or transmissive beam splitter or other type light distributor.

Figure 18:
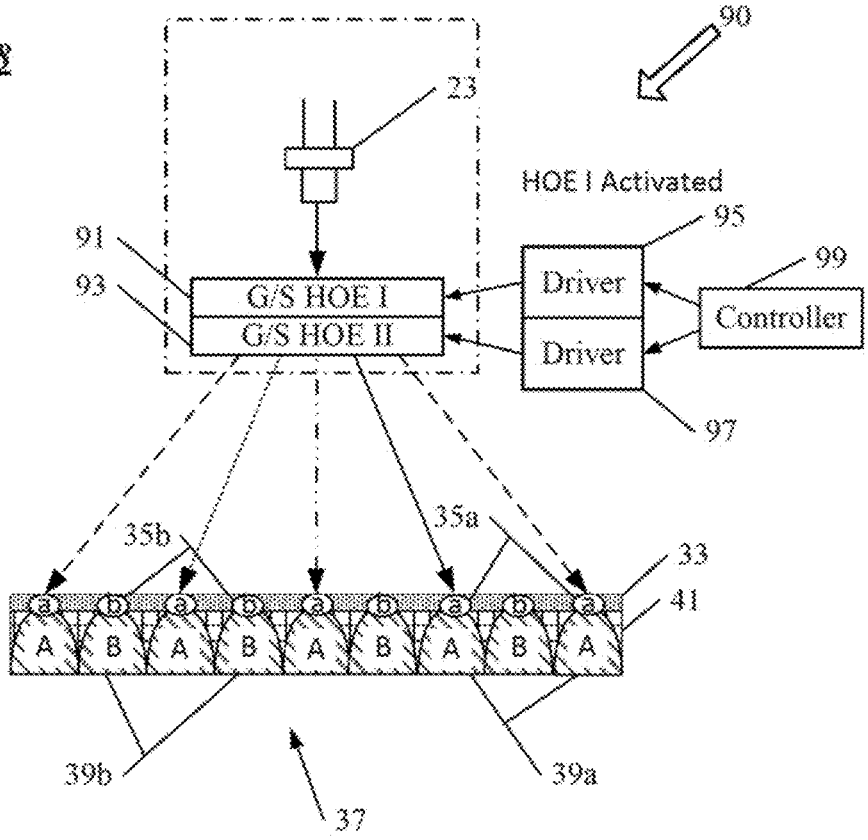
FIGS. 18 and 19 are side/partial cross-sectional views of another example tunable laser-based luminaire, using liquid crystal gated or switchable holographic elements and associated drivers, to select one of two holograms to receive and process the laser beam from the source.
Figure 19:
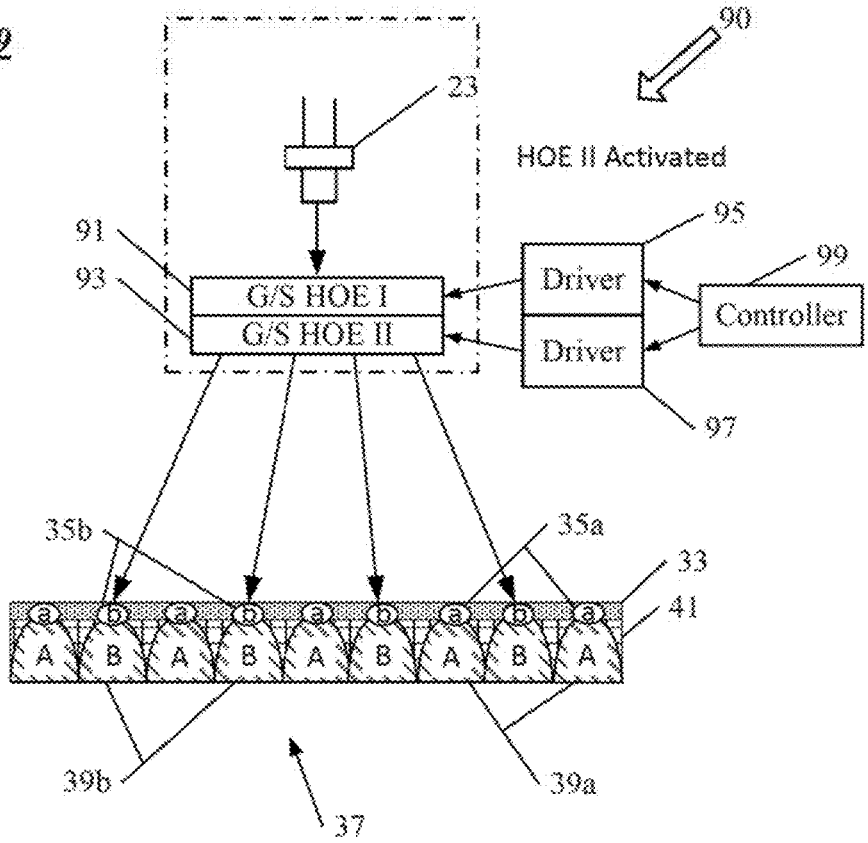

FIGS. 18 and 19 are side/partial cross-sectional views of an example tunable laser-based luminaire 90, using two such selectively gated/switchable (G/S) holographic optical elements 91, 93 to provide both the holograms and the mechanism(s) to selectively apply the beam of light from the laser diode 23 of the laser light source to the different holograms, in first and second states respectively. Additional gated/switchable holograms may be provided for use in other luminaire states.

A luminaire may utilize one or more gated/switchable holographic optical elements that are reflective, either in the holographic state or the non-holographic state or both states. The illustrated example, however, utilizes G/S holographic optical elements 91, 93 that are transmissive in the non-holographic state and implement transmissive beam distribution (e.g. act as transmissive beam splitters) in the holographic state.

The light source using a laser diode 23 is the same as in several of the earlier examples. As in other examples, only one diode 23 is shown for convenience, however, the laser light source in the luminaire 90 may include one or more additional laser diodes. Each of the G/S holographic optical elements 91, 93, for example, may be an HPDLC device. The holograms formed in the LC material in the example HPDLC devices may be similar to holograms discussed relative to the earlier examples, although here the holograms are implemented as parts of different G/S holographic optical elements 91, 93.

The switching capability in each of the G/S holographic optical elements 91, 93 supports at least two states. One state is holographic so that the hologram of the respective element is exposed to the beam of light from the last diode 23. In the other state, the G/S holographic optical element allows passage of light without light-interaction with the included hologram. Additional states may be supported.

The luminaire 90 includes circuitry forming at least one driver for the gates/switches of the holographic optical elements 91, 93. In the example, there is a separately controllable driver 95 or 97 for each of the GS holographic optical elements 91, 93. The circuitry of the drivers 95, 97 would depend on the type of gating/switching elements incorporated in the GS holographic optical elements 91, 93.

In one state shown in FIG. 18, a controller 99 (an example of which is discussed later with respect to FIG. 33) provides control signals to the drivers 95, 97 to operate the state-switching functionalities of the G/S holographic optical elements 91, 93 so that the hologram of element 91 is exposed to the beam of light from the laser diode(s) 23 to produce a first pattern of the diffracted/split beams and the hologram of element 93 passes that first pattern of the diffracted/split beams. In a second state shown in FIG. 19, the controller 99 provides control signals to the drivers 95, 97 to operate the state-switching functionalities of the holographic optical elements 91, 93 so that the hologram of element 91 passes the beam of light from the laser diode(s) 23 to the hologram of element 93 and to expose the hologram of element 93 to the laser beam. The hologram of element 93 in turn diffracts that light to produce a second pattern of the diffracted/split beams.

Depending on the implementation of the state-switching functionalities in the G/S holographic optical elements 91, 93, there may be one or more intermediate states, e.g. in which the elements 91, 93 together allow the beam to interact with and be distributed by both holograms.

Although other arrangements of photoluminescent material(s) and/or secondary optics may be utilized in various implementations of a luminaire like luminaire 90, the illustrated example (FIGS. 18 and 19) includes an arrangement similar to that used in the luminaire example FIGS. 3 and 5; and the same reference numbers are used to identify the elements of luminaire 90 that are structured and function in essentially the same ways as the similarly numbered elements of luminaire 20.

Hence, the luminaire 70 includes at least one phosphor bearing substrate 33, and the phosphor(s) in regions 35*a*, 35*b* that act as photoluminescent material(s) in this example are separated into relatively small sub-regions a, b at appropriate locations on the substrate 33 to receive the split beams from the patterns provided by the different holograms I, II on holographic optical element 25 in the two illustrated luminaire states shown in FIGS. 18 and 19.

Optionally, the example luminaire 90 of FIGS. 18 and 19 may include a 'secondary' (2nd) optical system 37 coupled to the photoluminescent material, i.e. to the phosphor(s) in regions 35*a*, 35*b* as in the earlier example. Although other optics may be used as outlined above, the illustrated example utilizes individual lenses 39*a*, 39*b*, as in the example of FIGS. 3 and 5. An optical support structure 41 holds the example lenses 39*a*, 39*b* of the optical system 37 in place, in an assembly together with the sub-regions of phosphor type photoluminescent material in regions 35*a*, 35*b* on the substrate 33, to provide suitable optical coupling of converted light from the phosphor(s) and blue light if any from the patterns that may pass through the phosphor(s) to the lenses 39*a*, 39*b*.

Other aspects and/or alternative implementations of the arrangement of the substrate, the photoluminescent material, the lenses or other optics and the support structure should be readily apparent from the discussion of FIGS. 3 and 5 above and/or other luminaire examples discussed herein.

Figure 20:
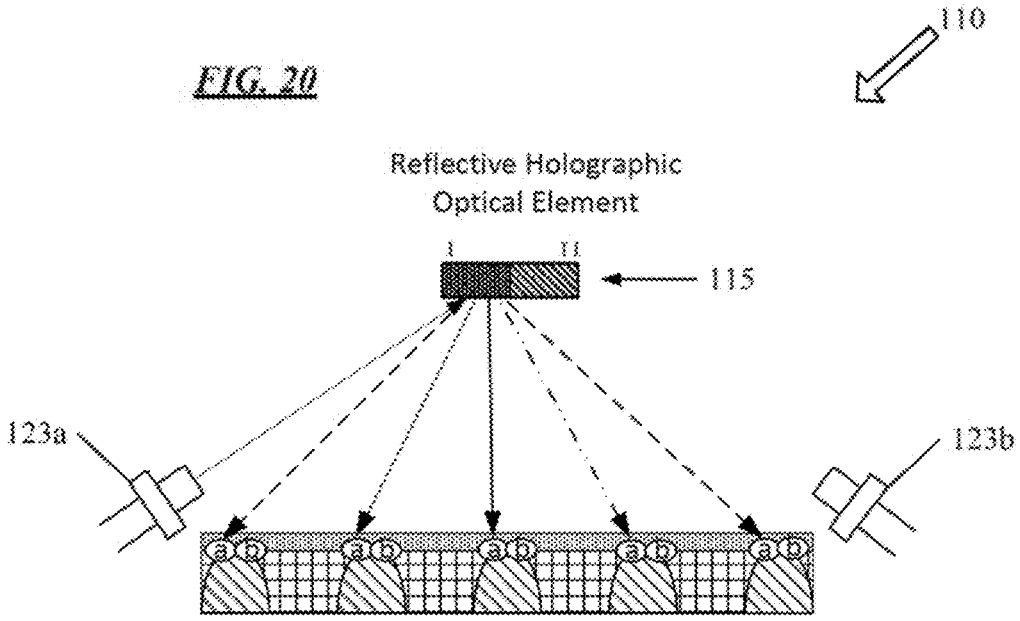
FIGS. 20 and 21 are side/partial cross-sectional views of a further example tunable laser-based luminaire, using a reflective holographic optical element with the two holograms as well as two selectively controlled lasers to select the beam directed to each hologram.
Figure 21:
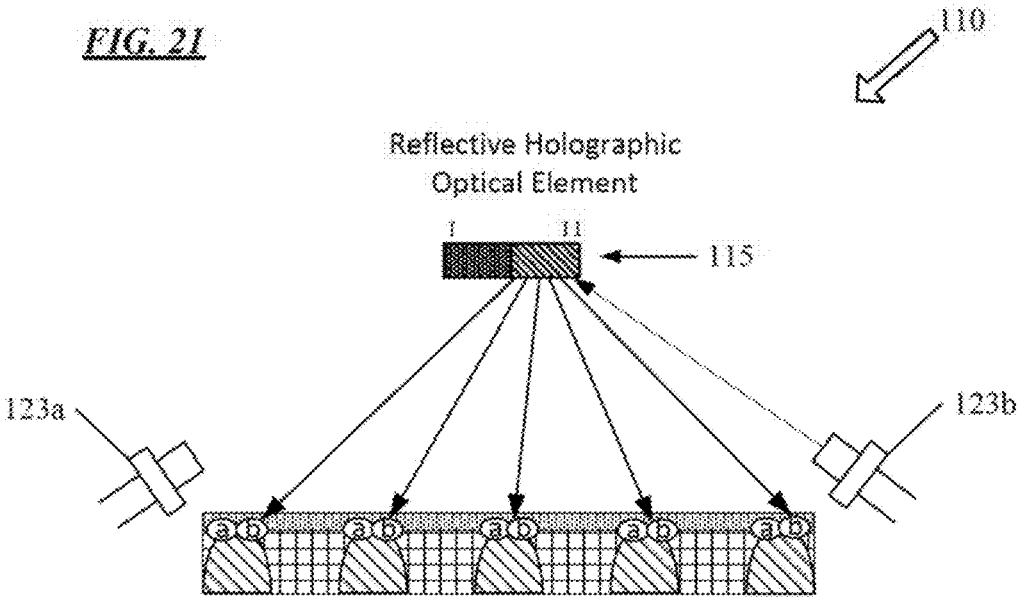

Another class of technologies for the selection among the holograms utilizes multiple, separately controllable laser beam emitters aimed or reflected to different holograms on one or more holographic elements. FIGS. 20 and 21 show two luminaire states of an example luminaire 110 that implements selected laser operation to select holograms in different states.

The luminaire 110 includes a sectioned reflective, diffractive holographic optical element (HOE) 115 having a first hologram (I) and a second hologram (II) in respective holographic regions of the element 115. The holographic optical element 115 and the holograms I and II are similar to those of the example of FIGS. 7 to 9, except that in this example luminaire 110, the holographic optical element 115 is stationary. As in earlier examples, there may be additional holograms providing additional light projection patterns.

For convenience of illustration and discussion of this example, the tunable laser based luminaire 110 includes a laser light source in the form of two selectively operable laser emitters, each formed of a laser diode 123*a* or 123*b*, although additional diodes or alternative laser emitters may be used. Each laser diode is the same as a laser diode 23 in the earlier examples. As in other examples, only one diode is shown producing each selectively controllable beam for convenience, however, each beam emitter of the laser light source in the luminaire 110 may include one or more additional laser diodes aimed or reflected to produce the respective beam shown impacting on the holographic optical element 115 in luminaire 110.

Although a luminaire like 110 may include mirrors (see e.g. FIGS. 7 to 9), the example of FIGS. 20 and 21 utilizes laser diodes 123*a*, 123*b* aimed directly at the different holograms I and II on the element 115. FIG. 20 illustrates as first luminaire state in which laser diode 123*a* is ON and directs its laser beam to hologram I for diffractive beam splitting to produce a first blue or UV light distribution. FIG. 21 shows a second luminaire state in which laser diode 123*a* is ON and directs its laser beam to hologram II for diffractive beam splitting to produce a second blue or UV light distribution. In the illustrated states, laser diode 123*b* is OFF in the first state (FIG. 20), and laser diode 123*a* is off in the second state (FIG. 21). Although not shown, the luminaire 110 may operate in one or more additional states in which both laser diodes 123*a*, 123*b* are ON concurrently, although the laser beam output intensity may be varied for a state for a particular general illumination application.

For convenience, these drawings show implementations of photoluminescent material and an optical system similar to those of FIGS. 13 and 14, although other arrangements of photoluminescent material and/or the optical system may be used in a luminaire otherwise similar to luminaire 110. The two blue or UV light distributions from the holograms in the different luminaire states and the resultant light output distributions in the two illustrated luminaire states are essentially the same as those of the luminaire 70' of FIGS. 13 and 14.

Figure 22:
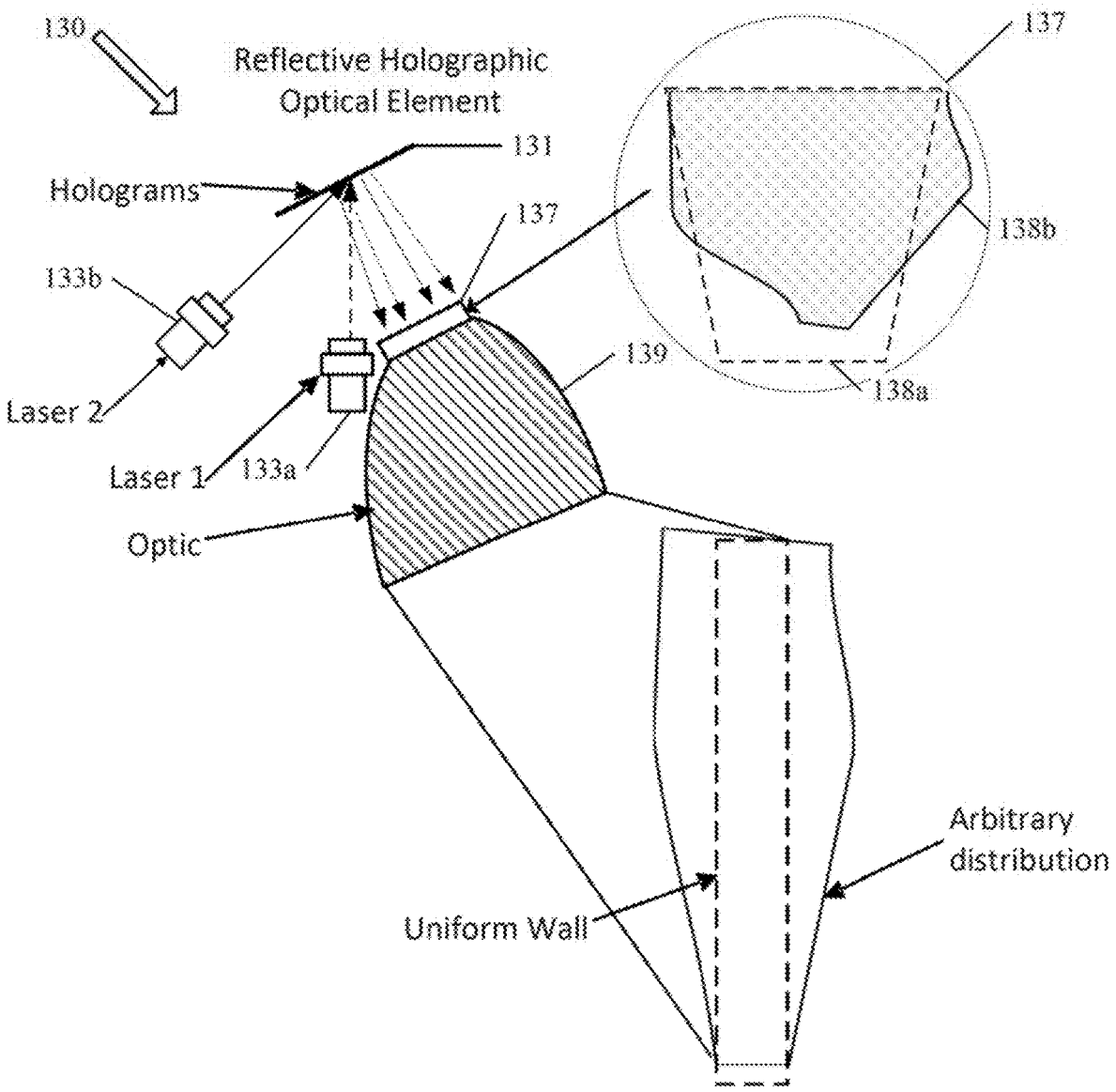
FIG. 22 is a side/partial cross-sectional view of another example tunable laser-based luminaire, using a reflective holographic optical element with the two holograms as well as two selectively controlled lasers, to provide two different output distributions through an optic.

FIG. 22 depicts an example tunable laser-based luminaire 130, using a reflective holographic optical element 131 with at least two holograms as well as two selectively controlled lasers, represented by laser diodes 133*a*, 133*b* aimed at different angles of incidence relative to the holographic optical element 131.

In the earlier examples, the holographic optical elements carried a number of holograms in regions corresponding to different surface areas or volumes of the elements, for individual beam exposures and producing corresponding individual blue or UV light output distributions. In the example of FIG. 22, the holographic optical element 131 has two or more holograms in region(s) thereof, but the holograms are designed to refract laser light received at different angles of incidence. For example, the holographic optical element may carry holograms at different orientations. The beams, however, may impact the same surface location or 'spot' on the holographic optical element 131 yet selectively expose the different holograms at different angles to produce different refractive beam splitting, responsive to the difference in angle of incidence of the laser beams relative to the holographic optical element 131.

The holograms may be selected by any suitable technique for selecting angles of incidence of laser light on the reflective holographic optical element 131. Although other angular selection techniques may be utilized, the example luminaire 130 enables hologram selection by selective operation of the two laser diodes 133*a*, 133*b* aimed at different angles toward a spot on the reflective holographic optical element 131.

For convenience of illustration and discussion of this example, the tunable laser based luminaire 110 therefore includes a laser light source in the form of two selectively operable laser emitters, each formed of a laser diode 133*a* or 133*b*, although additional diodes or alternative laser emitters may be used. Each laser diode is the same as a laser diode in the earlier examples. As in other examples, only one diode is shown producing each selectively controllable beam for convenience, however, each beam emitter of the laser light source in the luminaire 130 may include one or more additional laser diodes. The example assumes two holograms on element 131. If the element has one or more additional holograms selected by laser beam angle of incidence, the light laser source may include one or more additional laser emitters aimed toward the holographic optical element 131 at different angles of incidence.

In a first luminaire state, the first laser diode 133*a* emits a beam represented by a dashed arrow, and the hologram on element 131 that is responsive to the angle of incidence of the beam from laser diode 133*a* refractively splits that beam into a first projection pattern of beams represented by somewhat thinner dashed arrows. In a second luminaire state, the second laser diode 133*b* emits a beam represented by a solid arrow, and the hologram on element 131 that is responsive to the angle of incidence of the beam from laser diode 133*b* refractively splits that beam into a projection pattern of beams represented by somewhat thinner solid arrows. The luminaire 130 includes a phosphor material 137 (as an example type of photoluminescent material) and a secondary optic 139. The two luminaire states provide two different blue or UV light distributions to the phosphor material 137 for emissions therefrom through the optic 139.

Although other secondary optics or systems may be used, the example luminaire 130 has a single unified optic 139 coupled to the entire area of the phosphor material 137. The optic 139, for example, may be a single lens or a reflector (e.g. similar to any of the types of reflectors often used in downlights, or in wall wash or grazing fixtures, etc.). If made of a solid transmissive material, a surface of the optic 139 may act as a substrate to support the phosphor material 137. The patterns of illumination of the phosphor 137 by the projection from the holograms of element 131 together with the light distribution properties of the particular design of the optic 139 determine the angular distributions of the overall output of the luminaire 130 in the different luminaire states.

The drawing also shows an enlarged detail view of examples of the exposures of the surface of the phosphor material 137 in the different luminaire states. For convenience, the enlargement shows a circular example of the phosphor material 137, although other shapes of the phosphor material 137 may be used, particularly with non-circular implementations of the input area of the optic 139.

One hologram on holographic element 131 is configured to provide a first projection 138*a* (dashed shape outline, now shading) on the phosphor material 137 when that hologram is illuminated by the beam (dashed arrow) from the first laser diode 133*a*. The other hologram on the on holographic element 131 is configured to provide a different second projection 138*b* (solid shape outline, with shading) on the phosphor material 137 when that hologram is illuminated by the beam (solid arrow) from the second laser diode 133*b*. As shown in these examples, any one hologram may be designed to enable a state of a laser based luminaire to more readily provide an asymmetric light distribution for a particular general illumination application.

For a wall wash application or the like, it may be desirable for a luminaire like 130 to produce a light distribution on a wall or other architectural panel that a person would perceive as relatively uniform, as shown by the dashed shape outline. For that purpose, the first hologram on holographic optical element 137 is configured to provide a keystone and somewhat graded projection 138*a* of blue or ultraviolet light from the laser beam onto the phosphor material 137. The resulting converted light from the phosphor material 137 is directed through the optic 139 for the desired uniform wall illumination or the like. Where the illuminated surface of the wall is nearer to the luminaire, the hologram provides light over a wider area of the phosphor but at a lower intensity; whereas for areas down the wall and further from the luminaire, the hologram provides light over a wider area of the phosphor but at a progressively higher intensity, such that the overall illumination of the wall surface appears substantially uniform (e.g. the intensity on the wall is uniform or is free of gradient irregularities that might otherwise appear as striations).

For a different application, it may be desirable to have a different light output distribution. The intended luminaire output distribution may be any of a variety of arbitrary distributions, as represented by the example output distribution show in solid outline form in FIG. 22, which a designer or manufacturer deems suitable to a particular general illumination application. For that purpose, the second hologram on holographic optical element 137 is configured to provide a corresponding arbitrarily shaped and/or graded projection 138*b* of blue or ultraviolet light from the laser beam onto the phosphor material 137. The resulting converted light from the phosphor material 137 is directed through the optic 139 for the desired selected luminaire output light distribution.

FIGS. 23 to 26 are plan views of different arrangements of phosphor type photoluminescent materials as regions on differently shaped examples of substrates. The shapes of the substrates and the shapes and arrangements of the phosphors in these examples, however, are shown by way of non-limiting examples. In these examples, it is assumed that the substrates are flat, e.g. with a planar surface in the plane of the drawing sheet. The substrates, however, may be curved in a dimension orthogonal to the plane of the drawing sheet.

FIG. 23 shows a square array of phosphor spots, as sub-regions of photoluminescent materials, as might be used in a 2×2 luminaire. The spots having different shadings represent different phosphor mixtures, for example, to produce different color-characteristic white light in three different luminaire states.

FIG. 24 shows a somewhat arbitrary rectangular arrangement with a pattern of phosphor spots around the perimeter of the rectangular substrate. As in the previous example, spots having different shadings represent different phosphor mixtures, for example, to produce different color-characteristic white light in three different luminaire states. The region inside the rectangular arrangement of phosphor spots may be empty or filled by a portion of the substrate or other material and may or may not be transparent.

FIGS. 25 and 26 show circular arrangements of phosphors on circular substrates, as might be utilized in circular downlight or spotlight applications, to produce different color-characteristic white light in different luminaire states. In the example of FIG. 25, the phosphor materials are arranged as a central circular spot and concentric circular rings; and the drawing shows two different types of phosphors to produce two different color-characteristic white light in two different luminaire states. In the example of FIG. 26, the phosphor materials are arranged as a central circular spot in concentric rings of phosphor spots, of three different phosphors to produce different color-characteristic white light in three different luminaire states.

In the example of FIG. 25, the phosphors are shown as a center circular region and two concentric rings of two different materials (different shadings), where the circle and rings have different diameters. Different holograms could distribute light (derived from the laser beam) to the different concentric regions in two different luminaire states. In another approach not separately shown, a disk of phosphor material may be relatively continuous, but three different holograms could distribute light (derived from the laser beam(s)) to the different circular areas, e.g. a small central area (corresponding to the central circle in FIG. 25) an intermediate circular area (encompassed by the outer perimeter of the middle shaded ring in FIG. 25) and a maximum circular area (encompassed by the outer perimeter of the outer shaded ring in FIG. 25).

In the example of FIG. 26, the phosphors are shown as a center circular region and two concentric rings of phosphor spots, of three different materials (three different shadings), where the circle and rings have different diameters. Three different holograms could distribute light (derived from the laser beam) to the different concentric regions/spots in different luminaire states.

The numbers of rings or phosphor spots in the examples of FIGS. 23 to 26 are given for ease of illustration only. Actual luminaires may utilize fewer or more regions or sub-regions of photoluminescent materials. In each case, each hologram in the luminaire would be designed to distribute the light split from the laser beam to the regions or sub-regions of appropriate photoluminescent materials intended to be illuminated/pumped in the respective luminaire state.

Figure 27:
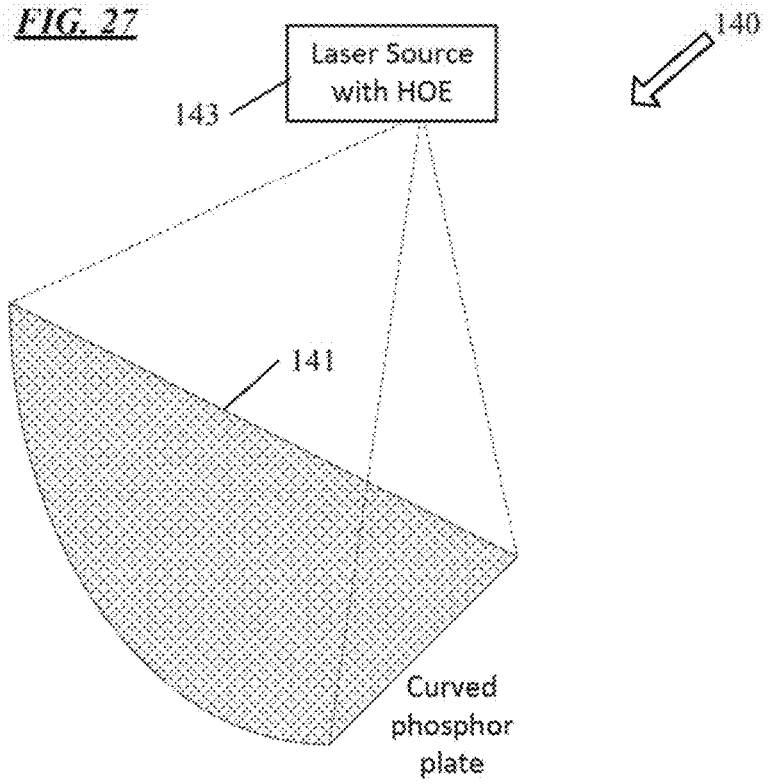
FIG. 27 is a partial block diagram/partial isometric view of a tunable luminaire including a laser light source and a selectively illuminated holographic optical element together with a curved phosphor-bearing plate.

The examples shown to this point have represented relatively flat arrangements of the photoluminescent material, e.g. on a flat or planar surface of a substrate or the like. As noted earlier, the laser and hologram based tunable luminaire technology may function with luminaire components for the photoluminescent materials and/or the output optics/surface of the luminaire that may be curved. FIG. 27 is a partial block diagram/partial isometric view of an example luminaire 140 including a curved phosphor-bearing plate 141; and FIG. 28 is a somewhat enlarged isometric view of the curved phosphor-bearing plate 141.

The laser diode(s) of the light source, the holographic optical element and the hologram selection technology may be implemented in any of the ways described above and, for convenience, are shown collectively as a single block or module 143 in FIG. 27.

In some cases, each of the holograms in such block or module 143 may not necessarily be changed from that for a flat plate (e.g. as in FIGS. 3 and 5) with a similar perimeter, for example, in luminaires where curved substrates (e.g. FIGS. 27 and 28) carry or are coated with a relatively continuous photoluminescent material (e.g. later FIGS. 29 to 32). In other cases, e.g. if the distribution needs to be changed to direct light to a substantially different set of locations of phosphor sub-regions 145*a* or 145*b* or to provide a different output intensity profile, for a different luminaire design or application, the unit shown at 143 only needs to have a different hologram for the respective luminaire state imprinted on the holographic optical element.

Figure 28:
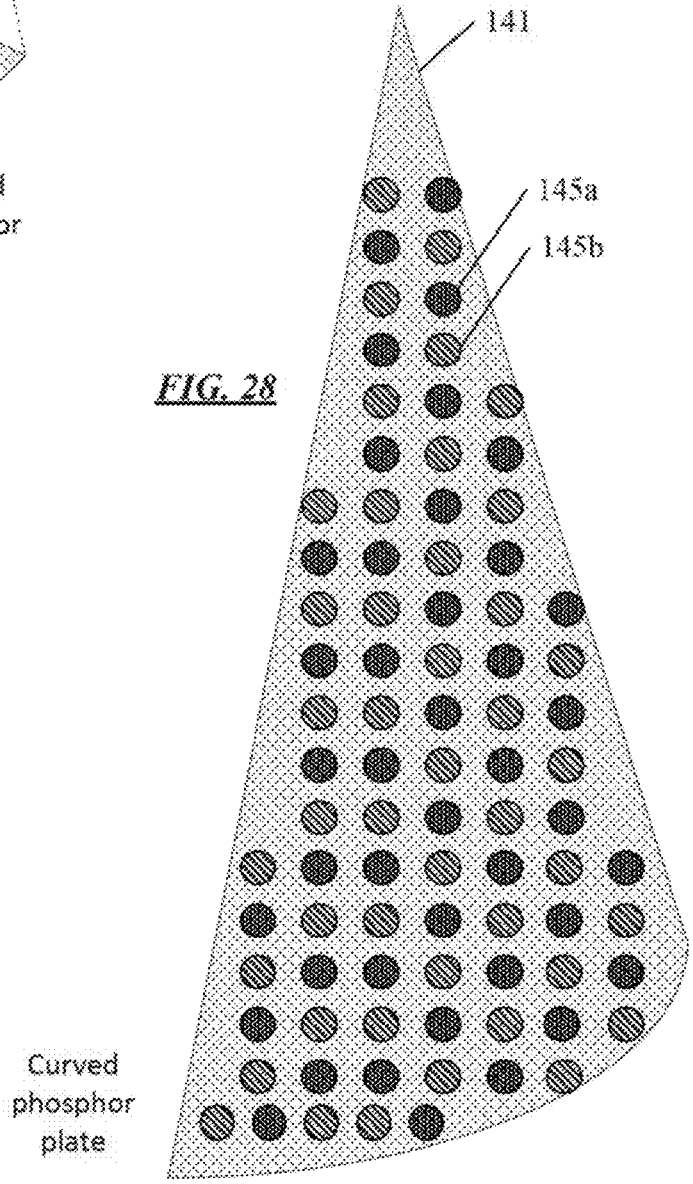
FIG. 28 is a somewhat enlarged isometric view of the curved phosphor-bearing plate of the example luminaire of FIG. 27 that also shows an example arrangement of phosphor regions on the curved substrate of the plate.

In the example of FIG. 27, the block 143 would include a holographic optical element on which the holograms are designed to split and distribute light of the laser beam in somewhat triangular distributions in two dimensions to the respective phosphor spots 145*a*, 145*b* shown in FIG. 28 and that may also have a variation in a third dimension. Each hologram is tailored to distribute the light to a curved region sub-regions of photoluminescent materials on a curved substrate/plate. In the example, the luminaire 140 includes a curved phosphor plate 141. As shown in FIG. 28, the photoluminescent material is formed as phosphor spots 145*a*, 145*b* distributed across the curved plate 141, although a uniform distribution of photoluminescent material across the plate 141 may be used for some general illumination applications.

It should be apparent that the laser diode(s) of the light source and the holographic optical element with the selectable holograms may be utilized with flat or curved arrangements, and many of the examples depicted the photoluminescent materials as phosphor spots. As noted, the photoluminescent materials may be distributed as a relatively uniform layer exposed to distributed light from the hologram. FIGS. 29 to 32 show several examples using phosphor layers.

Figure 29:
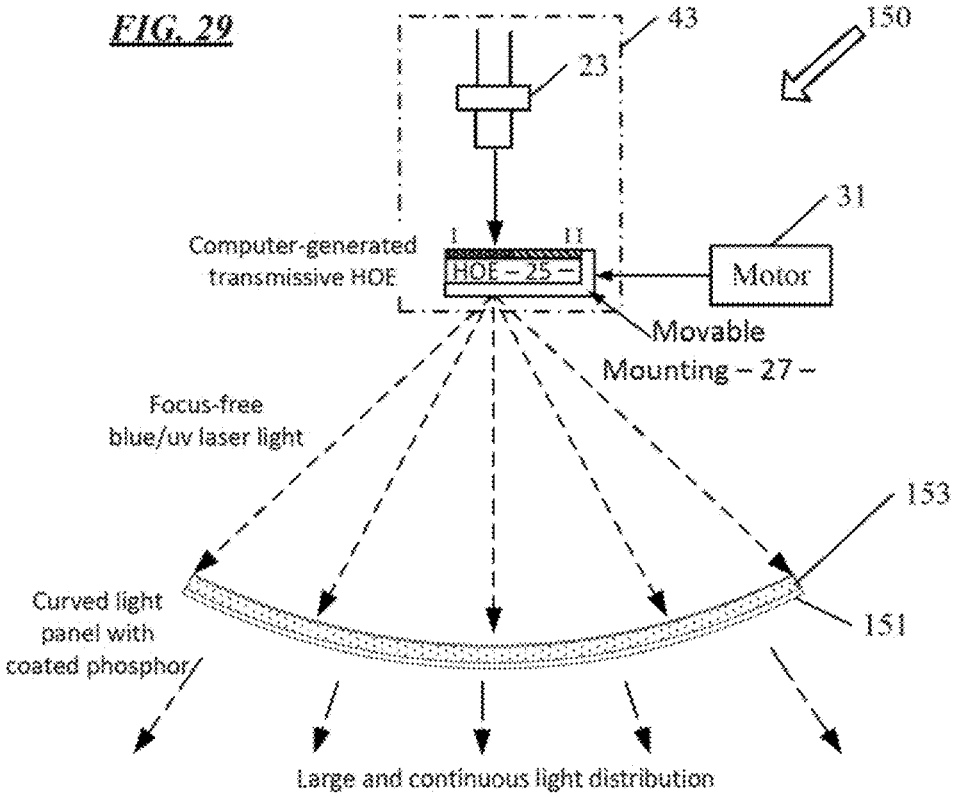
FIGS. 29 and 30 are side/partial cross-sectional views of a further example tunable laser-based luminaire, using a laser and a movable holographic optical element to provide different distributions of light to a photoluminescent material on a curved plate, in first and second luminaire states respectively.
Figure 30:
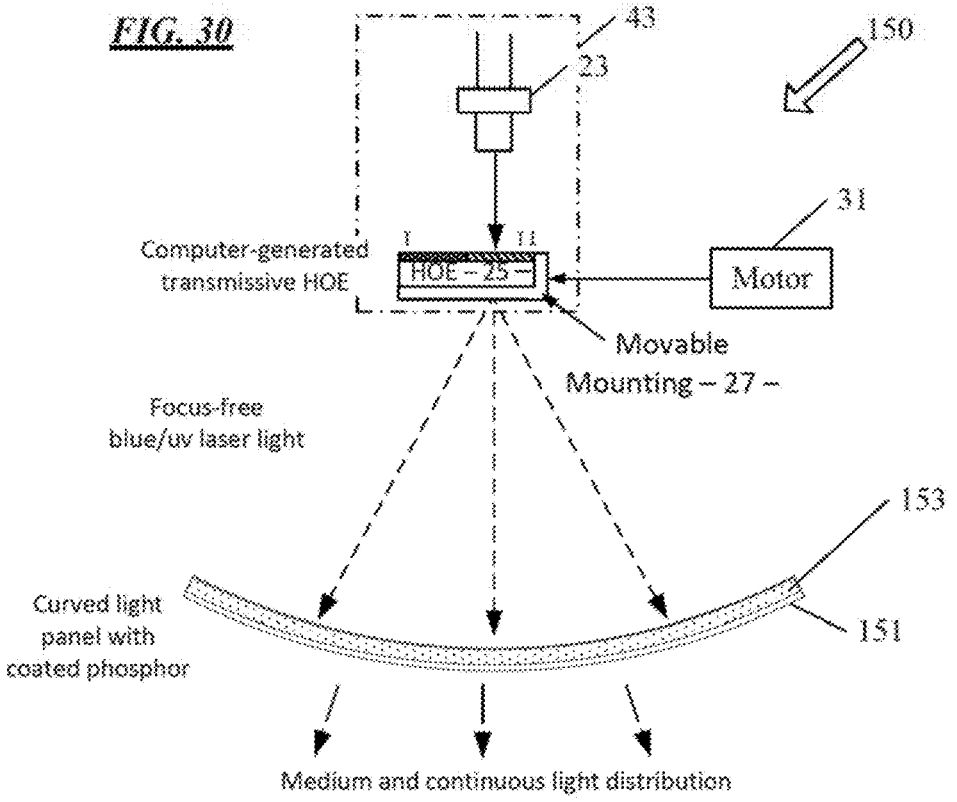

Although applicable to other laser and hologram arrangements, the example luminaire 150 of FIGS. 29 and 30 is shown using a module 43 similar to that shown in FIGS. 3 and 5 by way of a non-limiting example. Such a module 43 includes the laser diode 23, a holographic optical element 25 with holograms I, II and a movable mounting 27 for the element 25, as discussed above. Although the luminaire 150 may support manual actuation, the moveable mounting 27 in this example is actuated by an automated mechanism represented by the motor 31.

Such a module and hologram selection arrangement may be used with different substrates (e.g. flat as in the examples of FIGS. 3 to 22, curved as in FIGS. 29 and 30 or having a wave as in FIGS. 31 and 32) for the photoluminescent material and/or with different optical systems. In some cases, each hologram may be changed for different phosphor and/or substrate arrangements, e.g. if the distribution needs to be changed to direct light to a substantially different set of phosphor sub-regions in a different luminaire design. In other cases, e.g. where differently shaped substrates carry or are coated with a relatively continuous photoluminescent material, it may not even be necessary to change either hologram to use the module 43 in a different luminaire design.

In addition to the module 43, the example luminaire 150 of FIGS. 29 and 30 has a curved light panel formed of a curved substrate 151 and a phosphor layer 153. For example, the substrate 151 may be a curved sheet of a material sometimes used for a light waveguide or the like, and the phosphor layer 153 may be coated on the curved sheet. Although not shown, an optical film or the like may be provided on the output surface of the curved sheet. The example luminaire 150 also provides a large continuous light output distribution.

The cross-section of the curved sheet 151 and the curved phosphor coating 153, of the curved light panel, are illustrated as having curvatures corresponding to sections of concentric circles (curved in the plane of the drawing sheet). A similar luminaire may have a sheet and phosphor coating that also curve in an orthogonal dimension (perpendicular to the plane of the drawing sheet), for example, in which the curved sheet 151 of the light panel and the curved phosphor coating 153 have spheric curvatures (corresponding to sections of concentric spheres). More complex curved structures, for example having different curvatures in different dimensions, may be used for desired illumination applications and/or for aesthetic design considerations.

In one state shown in FIG. 29, a controller (an example of which is discussed later with respect to FIG. 33) provides a control signal to the motor 31 to operate the moveable mounting 27 to the position in which the laser beam from laser diode 23 impacts the first hologram I of the holographic optical element 25, and the hologram I produces a first pattern of the diffracted/split beams. The diffracted pattern in this first luminaire state pumps the phosphor layer 153 to produce a large and continuous light output distribution from the output of the luminaire 150 via the plate 151. In a second state shown in FIG. 30, the controller provides a control signal to the motor 31 to operate the moveable mounting 27 to the position in which the laser beam from laser diode 23 impacts the second hologram II of the holographic optical element 25, and the hologram II produces a second pattern of the diffracted/split beams. The diffracted pattern in this second state pumps the phosphor layer 153 to produce a continuous light output distribution from the output of the luminaire 150 via the plate 151; however, in this example the output distribution in the second has a smaller (e.g. medium) angular output range. Other differences in output distributions may be provided by the two different holograms in the two luminaire states.

Figure 32:
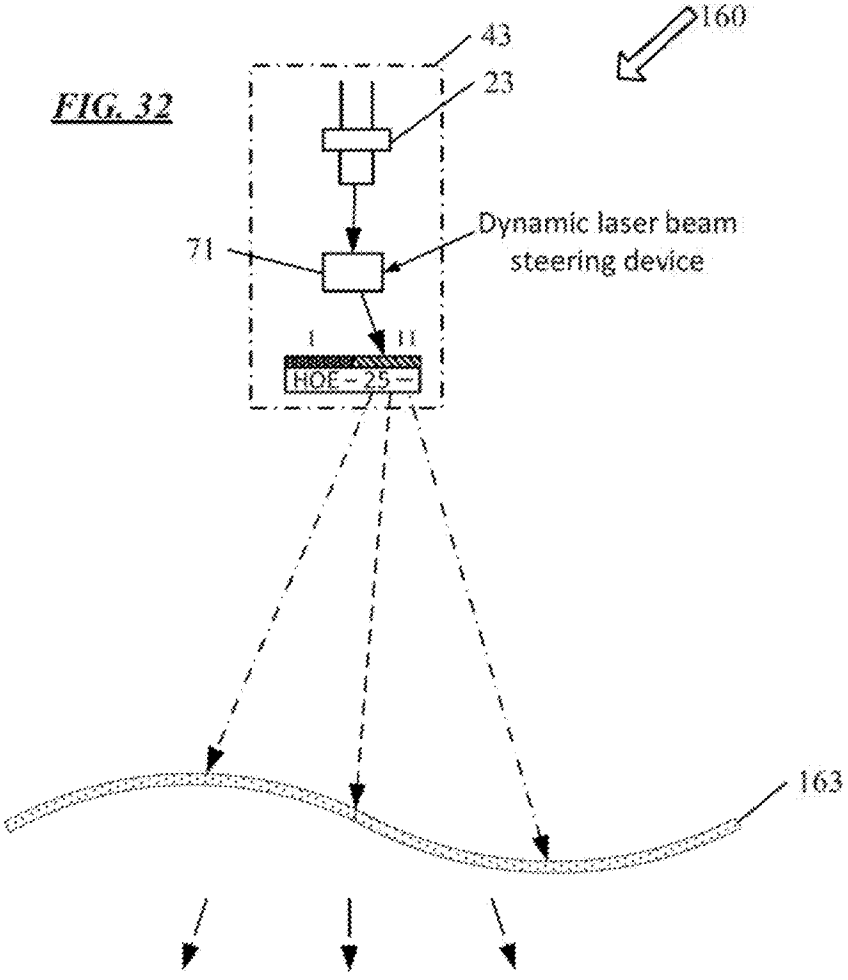
FIGS. 31 and 32 are side/partial cross-sectional views of another example tunable laser-based luminaire, using a laser, a beam steering optic and a movable holographic optical element to provide different distributions of light to a curved photoluminescent material, in first and second luminaire states respectively.
Figure 31:
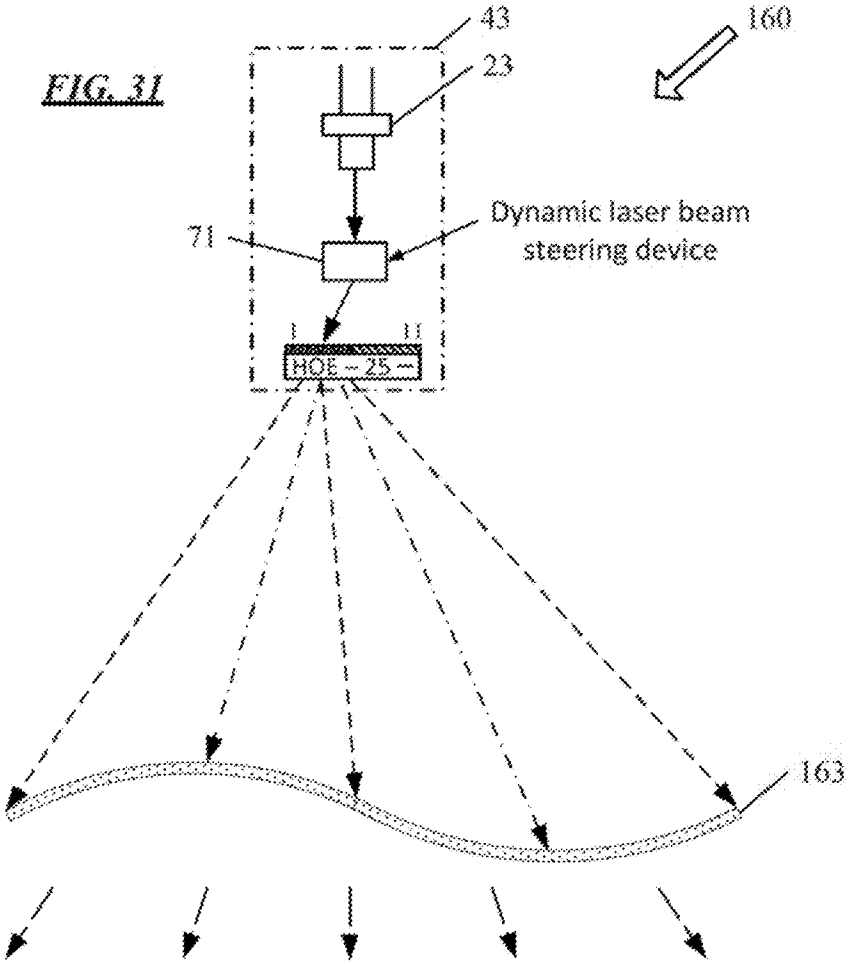
Figure 13:
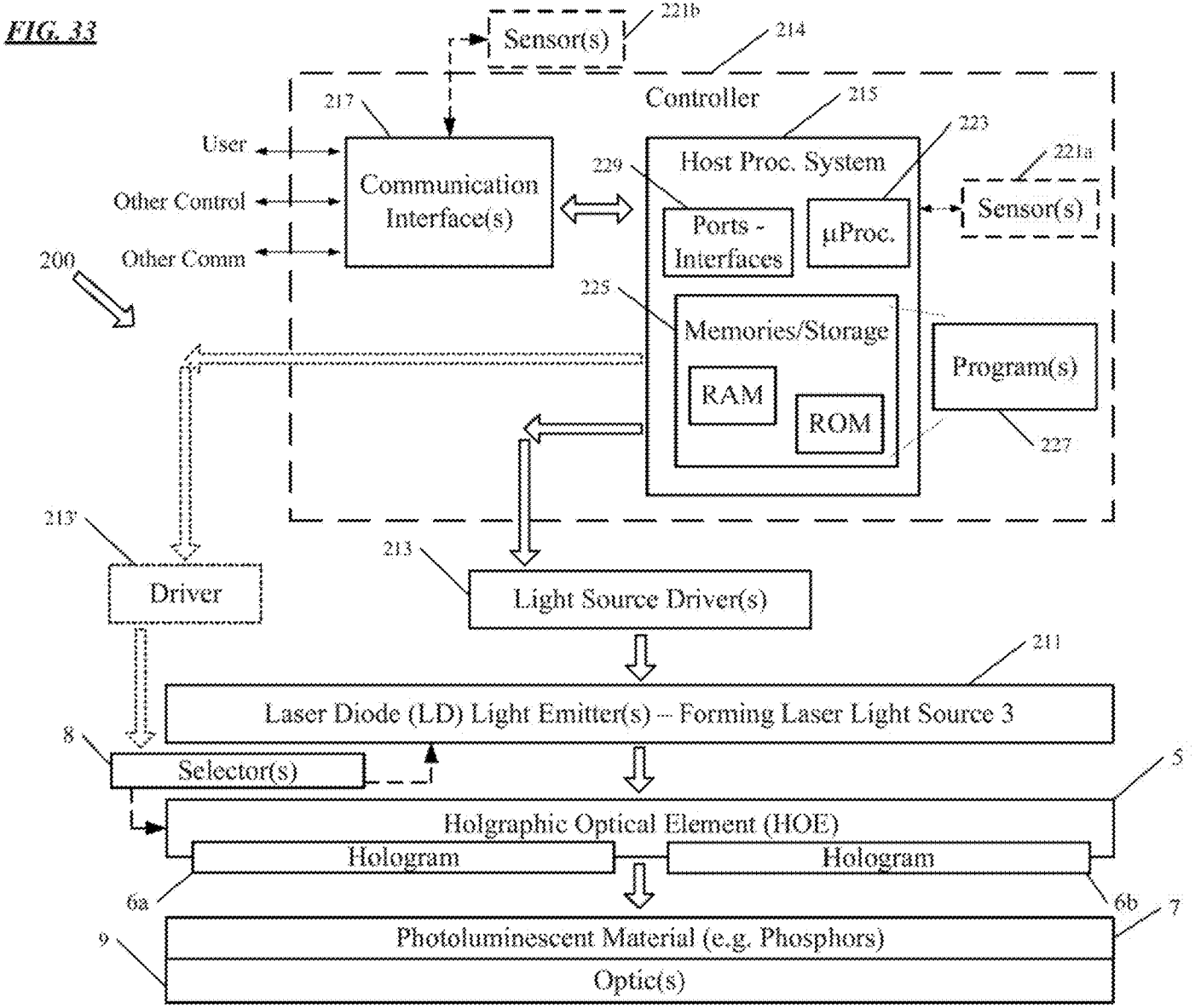

Although applicable to other laser and hologram arrangements, the example luminaire 160 of FIGS. 31 and 32 is shown using a module 43 similar to that shown in FIGS. 10 and 11 by way of a non-limiting example. Such a module 43 includes the laser diode 23, a fixed holographic optical element 25 with holograms I, II and a dynamic laser beam steering device, as discussed above.

Such a module and hologram selection arrangement may be used with different substrates (e.g. flat as in the examples of FIGS. 3 to 22, curved as in FIGS. 29 and 30 or having a wave as in FIGS. 31 and 32) for the photoluminescent material and/or with different optical systems. In some cases, each hologram may be changed for different phosphor and/or substrate arrangements, e.g. if the distribution needs to be changed to direct light to a substantially different set of phosphor sub-regions in a different luminaire design. In other cases, e.g. where differently shaped substrates carry or are coated with a relatively continuous photoluminescent material, it may not even be necessary to change either hologram to use the module 43 in a different luminaire design.

In addition to the module 43 with the laser diode(s) 23, the laser beam steering device 71 and the holographic element 25, the example luminaire 160 of FIGS. 31 and 32 has a wavy photoluminescent material 163. Depending on the material utilized, the material 163 may be self-supporting or supported by an appropriately shaped substrate (not shown) bearing the phosphor(s) on one or more surfaces of the substrate or having the phosphor(s) doped or otherwise embedded in the substrate. The wavy contour in the planar cross-section is given by way of a simple example. The wavy photoluminescent material 163 may have more complex contours.

In one state shown in FIG. 31 a controller (an example of which is discussed later with respect to FIG. 33) provides a control signal to the beam steering device 71 to direct the laser beam from laser diode 23 to the first hologram I of the holographic optical element 25, and the hologram I produces a first pattern of the diffracted/split beams. The diffracted pattern in this first luminaire state pumps the phosphor layer 163 to produce a large and continuous light output distribution from the output of the luminaire 160. In a second state shown in FIG. 32, the controller provides a control signal to the beam steering device 71 to direct the laser beam from laser diode 23 to the second hologram II of the holographic optical element 25, and the hologram II produces a second pattern of the diffracted/split beams. The diffracted pattern in this second state pumps the phosphor layer 163 to produce a continuous light output distribution from the output of the luminaire 160; however, in this example the output distribution in the second has a smaller (e.g. medium) angular output range. Other differences in output distributions may be provided by the two different holograms in the two luminaire states.

The tunable hologram approach may be applied to examples in the above-incorporated earlier U.S. application Ser. No. 16/030,193, Filed Jul. 9, 2018, entitled LASER ILLUMINATION LIGHTING DEVICE WITH SOLID MEDIUM FREEFORM PRISM OR WAVEGUIDE, for example, by using an optical element with multiple holograms and moving the holographic optical element relative to the prism or waveguide (and thus relative to the laser beam) to select a different hologram and thus a different output distribution.

The drawings and the descriptions of laser based luminaires above have included a variety of example structures for the luminaire components and arrangements of such components. It should be understood that those structures and arrangements are non-limiting and that other structures for some or all of the components and/or other component arrangements may be utilized. For example, the drawings show photoluminescent materials and substrates arranged for transmission of light therethrough. The laser-based general illumination luminaire, however, may instead utilize reflective photoluminescent materials or reflective substrates for the photoluminescent materials.

Luminaires of the types disclosed herein may be adapted for transmission of data via modulation of the generation of the beam or beams by the laser light source. Although some of the laser light is absorbed by the photoluminescent material to cause the material to generate light of different wavelengths, some of the laser light passes through the photoluminescent material. The combined light output from the luminaire, for example, may appear white, in many of the luminaire examples described herein. Traditional yellow emitting phosphors cause a delay. The portion of the laser light distributed from the holographic element that passes through the photoluminescent material without wavelength conversion, however, will still exhibit the modulation applied at the laser light source. If the yellow phosphor transition cycle time is too long to carry the data, the receiver may include a blue pass filter and respond to modulation on the blue light from the holographic optical element. More modern QD phosphors cycle more rapidly, which may mitigate/switch this issue.

The luminaire design provides high optical efficiency of the system as well as high optical efficiency for diffraction. A laser-based luminaire may offer high optical efficiency for beam steering of highly polarized light carrying the data. Amplitude-shift keying (ASK) modulation stays valid after diffraction and is suitable for data communication in the example laser-based luminaires, although other modulation techniques may be used.

A high-speed laser light source, for example, may support giga bit per second (Gbps) or higher data communication rates. The modulation, however, only requires modulated driving of a small number of laser light emitters, as compared to modulating outputs of a larger number of LEDs in more traditional solid state luminaires.

FIG. 33 is a high-level functional block diagram of a smart implementation of a lighting device, which utilizes a laser light source, a holographic optical element, hologram selection, a photoluminescent material and an optical system as in one of the earlier tunable luminaire examples.

FIG. 33 is a high-level functional block diagram of a lighting device 100, which utilizes one or more laser diodes 211 forming the laser light source 3, a holographic optical element 5 with two or more holograms 6*a*, 6*b*, a photoluminescent material 7 (e.g. phosphors), one or more selectors 8, and an optical system 9 as in any one of the earlier luminaire examples. In many of the examples above, the selector 8 is a separate element as shown, although the selector function may be integrated in the light source driver 213 and/or the controller 214 (e.g. if selection involves selective activation among different laser emitters 211 of source 3 (see e.g. FIGS. 20 to 22)). Although other control architectures may be utilized, the example device 200 utilizes a processor based 'intelligent' arrangement with associated communication capabilities.

The example device 200 also includes the light source driver 213 coupled to selectively drive one or more individual laser diode type light emitters 211 of the laser light source 3. In its simplest form, the driver 213 may be controlled by a switch to apply power to the driver 213 or possibly a switch with a dimmer to provide simple adjustable control of the power supplied to the driver 213. In the illustrated 'smart' lighting device 200, however, the controller 214 is coupled to control the individual laser diodes 211, via the driver 213.

The driver 213 includes circuitry coupled to control light outputs generated by the laser diode type light emitters 211, for example, controllable power supply circuitry configured to variably supply appropriate drive current to one or more laser diodes 211 of a particular type. Although the driver 213 may be implemented as an element of the controller 214, in the example, the driver 213 is located separately from the controller 214. The driver 213 may be a separate device on one or more integrated circuits, or the driver 213 may be integrated on the sane semiconductor chip as some or all of the components of the controller 214.

The controller 214 is configured to control the laser diode type emitters 211 so as to operate the luminaire components as discussed earlier. For example, the controller 214 may adjust drive current supplied via driver 213 to the laser diodes 211 to provide dimming or to modulate the light output from the luminaire, e.g. to carry data. In examples that select laser emitters to select holograms, the controller 214 may control outputs of the driver 213 to select among the laser diodes 211.

For selectors that are separate from the driver of the laser emitters, the device 200 includes an additional driver 213' to operate the particular selector means. The driver 213' would be a circuit specifically configured to operate the particular type of selector(s) 8, e.g. to operate the motor or other mechanical actuator 31, to operate the particular type beam steering device 71 or to operate the gates/switches in the elements 91, 93.

Equipment implementing functions like those of lighting device 200 may take various forms. The laser light source 3 formed by the laser diodes 211, the holographic optical element 5, any additional selector 8, the photoluminescent material 7 and any optical system 9 will be elements of a light fixture or other type of luminaire. In some examples, the light source driver 213, the selector driver 213' (if provided) and/or the controller 214 also may be elements of a single hardware platform, e.g. a single laser and hologram based tunable luminaire. In other examples, some components attributed to the lighting device 200 may be separated from the laser diodes 211, the holographic optical element 5, any separate selector 8, the photoluminescent material 7 and any optical system 9 in the luminaire. Stated another way, a light fixture or other suitable type of luminaire may have all of the above hardware components of the device 200 on a single hardware device or in different somewhat separate units. In a particular hardware-separated example, one set of the hardware components may be separated from the luminaire, such that the controller 214, the driver 213 and the driver 213' may control laser diode emitters 211 and selector(s) 8 from a remote location. In an alternative example, with each luminaire including the driver(s) 231 and/or 213' together with the laser diode(s) 211 etc., one controller 214 may control a number of such luminaires.

As shown by way of example in FIG. 33, the controller 214 of the lighting device 200 includes a host processing system 215 and one or more communication interface(s) 217. The host processing system 215 provides the high level logic or "brain" of the device 200. In the example, the host processing system 215 includes data storage/memories 225, such as a random access memory and/or a read-only memory, as well as programs 227 stored in one or more of the data storage/memories 225. The host processing system 215 also includes a central processing unit (CPU), shown by way of example as a microprocessor (μP) 223, although other processor hardware may serve as the CPU. An alternate implementation, for example, might utilize a microcontrol unit (MCU) which incorporates the CPU processor circuitry, the memories, interfaces for input/output ports, etc. on a single system on a chip (SoC).

The host processing system 215 is coupled to the communication interface(s) 217 for communication with the microprocessor 223 via an appropriate one of the ports/interfaces 229. In the example, the communication interface(s) 217 offer a user interface function or communication with hardware elements providing a user interface for the general illumination device 200. The communication interface(s) 217 may communicate with other lighting devices (similar to or different from laser based device 200) at a particular premises. The communication interface(s) 217 may communicate with other control elements, for example, a host computer of a building and control automation system (BCAS). The communication interface(s) 217 also may support device communication with a variety of other systems of other parties, e.g. the device manufacturer for maintenance or an on-line server, such as server for downloading of software and/or configuration data. If the device 200 will support light based data communication by modulating the laser light output and thus the luminaire light output, at least the downstream data for such communication may reach the lighting device 200 via a network coupled to the communication interface(s) 217.

The device 200 may also include one or more sensor(s) 221*a* or 221*b*. The sensors may be included in the controller 214 as shown at 221*a* and communicate to the microprocessor 223 via an appropriate one of the ports/interfaces 229. Alternatively, one or more sensors 221*b* may be coupled via a communication interface to provide data for processing by the host processing system 214. A variety of sensors may be provided, such as an image sensor, an occupancy sensor, an ambient light sensor, a temperature sensor, etc.

The illustration, by way of example, shows a single processor in the form of the microprocessor 223. It should be understood that the controller 214 may include one or more additional processors, such as multiple processor cores, parallel processors, or specialized processors (e.g. a math co-processor or an image processor).

Although specially configured circuitry may be used in place of microprocessor 223 and/or the entire host processor system 215, the drawing depicts a processor-based example of the controller 214 in which functions relating to the controlled operation of the device 200 may be implemented by the programming 227 and/or configuration data stored in a memory device 225 for execution by the microprocessor 223 (or other type of processor). The programming 227 and/or data configure the processor 223 to control system operations so as to implement functions of the device 200 described herein, including selection of holograms for the various luminaire states, for example, in response to user inputs, sensor inputs, a timing algorithm implement via programming for the processor, instructions received via a network communication, etc.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises or includes a list of elements or steps does not include only those elements or steps but may include other elements or steps not expressly listed or inherent to such process, method, article, or apparatus. An element preceded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. Such amounts are intended to have a reasonable range that is consistent with the functions to which they relate and with what is customary in the art to which they pertain. For example, unless expressly stated otherwise, a parameter value or the like may vary by as much as ±10% from the stated amount.

In addition, in the foregoing Detailed Description, it can be seen that various features are grouped together in various examples for the purpose of streamlining the disclosure. This method of disclosure is not to be interpreted as reflecting an intention that the claimed examples require more features than are expressly recited in each claim. Rather, as the following claims reflect, the subject matter to be protected lies in less than all features of any single disclosed example. Thus the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A luminaire, for a general illumination application, the luminaire comprising:

a laser light source;

a holographic optical element having first and second holograms, the holograms being configured to distribute a beam of light from the laser light source into different first and second patterns of light, wherein:

the laser light source and the holographic optical element are configured relative to each other so that the beam of light from the laser light source can be selectively directed to the first of the holograms in a first state of the luminaire and directed to the second of the holograms in a second state of the luminaire, the laser light source pumps the at least one photoluminescent material to provide white light output from the luminaire of first characteristics suitable for the general illumination application in the first state of the luminaire, the laser light source pumps the at least one photoluminescent material to provide white light output from the luminaire of second characteristics suitable for the general illumination application in the first state of the luminaire, and at least one of the second characteristics of the white light output from the luminaire is different from a corresponding one of the first characteristics of the white light output from the luminaire;

first and second regions of at least one photoluminescent material, wherein:

the first region of photoluminescent material is located so as to receive the first pattern of light from the first of the holograms in the first state of the luminaire, and the second region of photoluminescent material is located so as to receive the second pattern of light from the second of the holograms in the second state of the luminaire; and an optical system coupled to the first and second regions of photoluminescent material, wherein the optical system comprises:

a first optic coupled to the first region of photoluminescent material, a second optic coupled to the second region of photoluminescent material, and the first and second optics provide different light output distributions.

2. The luminaire of claim 1, wherein the first and second regions of photoluminescent material contain different photoluminescent materials to convert light from the first and second patterns of light to output lights of different first and second color characteristics.

3. The luminaire of claim 2, further comprising:

a transparent substrate, wherein the different photoluminescent materials are located on different first and second regions of the transparent substrate.

4. A luminaire, for a general illumination application, the luminaire comprising:

a laser light source;

a holographic optical element having first and second holograms, the holograms being configured to distribute a beam of light from the laser light source into different first and second patterns of light, wherein:

the laser light source and the holographic optical element are configured relative to each other so that the beam of light from the laser light source can be selectively directed to the first of the holograms in a first state of the luminaire and directed to the second of the holograms in a second state of the luminaire, the laser light source pumps the at least one photoluminescent material to provide white light output from the luminaire of first characteristics suitable for the general illumination application in the first state of the luminaire, the laser light source pumps the at least one photoluminescent material to provide white light output from the luminaire of second characteristics suitable for the general illumination application in the first state of the luminaire, and at least one of the second characteristics of the white light output from the luminaire is different from a corresponding one of the first characteristics of the white light output from the luminaire;

first and second regions of at least one photoluminescent material, wherein:

the first region of photoluminescent material is located so as to receive the first pattern of light from the first of the holograms in the first state of the luminaire, and the second region of photoluminescent material is located so as to receive the second pattern of light from the second of the holograms in the second state of the luminaire; and an optical system coupled to the first and second regions of photoluminescent material, wherein:

the optical system comprises a passive lens formed of a solid transparent material, the passive lens includes a compound input surface having different surface portions optically coupled to the first and second phosphor regions, and the passive lens further includes a compound output surface.

5. A luminaire, for a general illumination application, the luminaire comprising:

a laser light source;

a holographic optical element having first and second holograms, the holograms being configured to distribute a beam of light from the laser light source into different first and second patterns of light, wherein the laser light source and the holographic optical element are configured relative to each other so that the beam of light from the laser light source can be selectively directed to the first of the holograms in a first state of the luminaire and directed to the second of the holograms in a second state of the luminaire;

first and second regions of at least one photoluminescent material, wherein:

the first region of photoluminescent material is located so as to receive the first pattern of light from the first of the holograms in the first state of the luminaire, and the second region of photoluminescent material is located so as to receive the second pattern of light from the second of the holograms in the second state of the luminaire; and a movable mounting structure supporting the holographic optical element, wherein:

the movable mounting structure is configured to selectively position the holographic optical element at a first location relative to the laser light source, in the first state of the luminaire, to receive the beam of light from the laser light source on a section of the holographic optical element containing the first hologram, and the movable mounting structure is configured to selectively position the holographic optical element at a second location relative to the laser light source, in the second state of the luminaire, to receive the beam of light from the laser light source on a section of the holographic optical element containing the second hologram.

6. The luminaire of claim 5, further comprising a motor coupled to the movable mounting structure, to automatically move the holographic optical element to and from the first and second locations in response to appropriate control signals.

7. A luminaire, for a general illumination application, the luminaire comprising:

a laser light source;

a holographic optical element having first and second holograms, the holograms being configured to distribute a beam of light from the laser light source into different first and second patterns of light, wherein the laser light source and the holographic optical element are configured relative to each other so that the beam of light from the laser light source can be selectively directed to the first of the holograms in a first state of the luminaire and directed to the second of the holograms in a second state of the luminaire;

first and second regions of at least one photoluminescent material, wherein:

the first region of photoluminescent material is located so as to receive the first pattern of light from the first of the holograms in the first state of the luminaire, and the second region of photoluminescent material is located so as to receive the second pattern of light from the second of the holograms in the second state of the luminaire; and a variable beam steering optic coupled to the laser light source, wherein the variable beam steering optic is configured to selectively, automatically steer the beam of light from the laser light source to different sections of the holographic optical element containing the first and second holograms in response to appropriate control signals.

8. A luminaire, for a general illumination application, the luminaire comprising:

a laser light source;

a holographic optical element having first and second holograms, the holograms being configured to distribute a beam of light from the laser light source into different first and second patterns of light, wherein:

the holographic optical element comprises first and second selectively gated or switchable holographic elements containing the first and second holograms respectively, the laser light source and the holographic optical element are configured relative to each other so that the beam of light from the laser light source can be selectively directed to the first of the holograms in a first state of the luminaire and directed to the second of the holograms in a second state of the luminaire, in the first state of the luminaire, the first selectively gated or switchable holographic element is configured to optically process the beam of light from the laser light source via the first hologram, in the first state of the luminaire, the second selectively gated or switchable holographic element is configured to pass light of the first pattern of light from the first selectively gated or switchable holographic element without optically processing light of the first pattern of light via the second hologram, in the second state of the luminaire, the first selectively gated or switchable holographic element is configured to pass light of the beam of light from the laser light source to the second selectively gated or switchable holographic element, without processing via the first hologram, and in the second state of the luminaire, the second selectively gated or switchable holographic element is configured to optically process the beam of light from the laser light source via the second hologram; and first and second regions of at least one photoluminescent material, wherein:

the first region of photoluminescent material is located so as to receive the first pattern of light from the first of the holograms in the first state of the luminaire, and the second region of photoluminescent material is located so as to receive the second pattern of light from the second of the holograms in the second state of the luminaire.

9. The luminaire of claim 8, wherein the first and second selectively gated or switchable holographic elements respectively comprise first and second liquid crystal controlled holograms.

10. A luminaire, for a general illumination application, the luminaire comprising:

a laser light source;

a holographic optical element having first and second holograms, the holograms being configured to distribute a beam of light from the laser light source into different first and second patterns of light, wherein:

the laser light source and the holographic optical element are configured relative to each other so that the beam of light from the laser light source can be selectively directed to the first of the holograms in a first state of the luminaire and directed to the second of the holograms in a second state of the luminaire the laser light source comprises:

a selectively controllable first laser emitter aimed to direct laser light at the first hologram in the first state of the luminaire, and a selectively controllable second laser emitter aimed to direct laser light at the second hologram in the second state of the luminaire; and first and second regions of at least one photoluminescent material, wherein:

the first region of photoluminescent material is located so as to receive the first pattern of light from the first of the holograms in the first state of the luminaire, and the second region of photoluminescent material is located so as to receive the second pattern of light from the second of the holograms in the second state of the luminaire.

11. A luminaire, for a general illumination application, the luminaire comprising:

a laser light source;

a holographic optical element having first and second holograms, the holograms being configured to distribute a beam of light from the laser light source into different first and second patterns of light, wherein the laser light source and the holographic optical element are configured relative to each other so that the beam of light from the laser light source can be selectively directed to the first of the holograms in a first state of the luminaire and directed to the second of the holograms in a second state of the luminaire; and a first optic and a second optic configured to provide different output distributions for light outputs of the luminaire, wherein:

the first optic is located so as to receive light based on the first pattern of light from the first of the holograms, in the first state of the luminaire, and the second optic is located so as to receive light based on the second pattern of light from the second of the holograms, in the second state of the luminaire.

12. The luminaire of claim 11, further comprising at least one photoluminescent material in an optical path between the holographic optical element and the first and second optics.

13. The luminaire of claim 11, further comprising:

a movable mounting structure supporting the holographic optical element, wherein:

the movable mounting structure is configured to selectively position the holographic optical element at a first location relative to the laser light source, in the first state of the luminaire, to receive the beam of light from the laser light source on a section of the holographic optical element containing the first hologram, and the movable mounting structure is configured to selectively position the holographic optical element at a second location relative to the laser light source, in the second state of the luminaire, to receive the beam of light from the laser light source on a section of the holographic optical element containing the second hologram.

14. The luminaire of claim 13, further comprising a motor coupled to the movable mounting structure, to automatically move the holographic optical element to and from the first and second locations in response to appropriate control signals.

15. The luminaire of claim 11, further comprising:

a variable beam steering optic coupled to the laser light source, wherein the variable beam steering optic is configured to selectively, automatically steer the beam of light from the laser light source to different sections of the holographic optical element containing the first and second holograms in response to appropriate control signals.

16. The luminaire of claim 11, wherein:

the holographic optical element comprises first and second selectively gated or switchable holographic elements containing the first and second holograms respectively;

in the first state of the luminaire, the first selectively gated or switchable holographic element is configured to optically process the beam of light from the laser light source via the first hologram;

in the first state of the luminaire, the second selectively gated or switchable holographic element is configured to pass light of the first pattern of light from the first selectively gated or switchable holographic element without optically processing light of the first pattern of light via the second hologram;

in the second state of the luminaire, the first selectively gated or switchable holographic element is configured to pass light of the beam of light from the laser light source to the second selectively gated or switchable holographic element, without processing via the first hologram; and in the second state of the luminaire, the second selectively gated or switchable holographic element is configured to optically process the beam of light from the laser light source via the second hologram.

17. The luminaire of claim 16, wherein the first and second selectively gated or switchable holographic elements respectively comprise first and second liquid crystal controlled holograms.

18. The luminaire of claim 11, wherein the laser light source comprises:

a selectively controllable first laser emitter aimed to direct laser light at the first hologram in the first state of the luminaire; and a selectively controllable second laser emitter aimed to direct laser light at the second hologram in the second state of the luminaire.

19. A luminaire, for a general illumination application, the luminaire comprising:

a laser light source;

a holographic optical element having first and second holograms, the holograms being configured to distribute a beam of light from the laser light source into different first and second patterns of light, wherein the laser light source and the holographic optical element are configured relative to each other so that the beam of light from the laser light source can be selectively directed to the first of the holograms in a first state of the luminaire and directed to the second of the holograms in a second state of the luminaire; and a passive lens formed of a solid transparent material, the passive lens including:

a compound input surface having different surface portions optically coupled to receive light based on the first pattern of light from the first of the holograms in the first state of the luminaire and to receive light based on the second pattern of light from the second of the holograms in the second state of the luminaire; and a compound output surface having different surface portions to output light with a first distribution in the first state of the luminaire and to output light with a second distribution in the second state of the luminaire.

20. The luminaire of claim 19, further comprising at least one photoluminescent material in an optical path between the holographic optical element and the compound input surface of the passive lens.

21. The luminaire of claim 19, further comprising:

a movable mounting structure supporting the holographic optical element, wherein:

the movable mounting structure is configured to selectively position the holographic optical element at a first location relative to the laser light source, in the first state of the luminaire, to receive the beam of light from the laser light source on a section of the holographic optical element containing the first hologram, and the movable mounting structure is configured to selectively position the holographic optical element at a second location relative to the laser light source, in the second state of the luminaire, to receive the beam of light from the laser light source on a section of the holographic optical element containing the second hologram.

22. The luminaire of claim 21, further comprising a motor coupled to the movable mounting structure, to automatically move the holographic optical element to and from the first and second locations in response to appropriate control signals.

23. The luminaire of claim 19, further comprising:

a variable beam steering optic coupled to the laser light source, wherein the variable beam steering optic is configured to selectively, automatically steer the beam of light from the laser light source to different sections of the holographic optical element containing the first and second holograms in response to appropriate control signals.

24. The luminaire of claim 19, wherein:

the holographic optical element comprises first and second selectively gated or switchable holographic elements containing the first and second holograms respectively;

in the first state of the luminaire, the first selectively gated or switchable holographic element is configured to optically process the beam of light from the laser light source via the first hologram;

in the first state of the luminaire, the second selectively gated or switchable holographic element is configured to pass light of the first pattern of light from the first selectively gated or switchable holographic element without optically processing light of the first pattern of light via the second hologram;

in the second state of the luminaire, the first selectively gated or switchable holographic element is configured to pass light of the beam of light from the laser light source to the second selectively gated or switchable holographic element, without processing via the first hologram; and in the second state of the luminaire, the second selectively gated or switchable holographic element is configured to optically process the beam of light from the laser light source via the second hologram.

25. The luminaire of claim 24, wherein the first and second selectively gated or switchable holographic elements respectively comprise first and second liquid crystal controlled holograms.

26. The luminaire of claim 19, wherein the laser light source comprises:

a selectively controllable first laser emitter aimed to direct laser light at the first hologram in the first state of the luminaire; and a selectively controllable second laser emitter aimed to direct laser light at the second hologram in the second state of the luminaire.

* * * * *